US009490570B1

(12) United States Patent
Hashiguchi

(10) Patent No.: US 9,490,570 B1
(45) Date of Patent: Nov. 8, 2016

(54) CONNECTOR HAVING A FLOATING STRUCTURE

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/058,401

(22) Filed: Mar. 2, 2016

(30) Foreign Application Priority Data

May 20, 2015 (JP) ..... 2015-102941

(51) Int. Cl.

| | |
|---|---|
| ***H01R 13/631*** | (2006.01) |
| ***H01R 13/502*** | (2006.01) |
| ***H01R 13/52*** | (2006.01) |
| ***H01R 24/66*** | (2011.01) |
| ***H01R 13/28*** | (2006.01) |
| ***H01R 12/91*** | (2011.01) |

(52) U.S. Cl.
CPC ..... *H01R 13/502* (2013.01); *H01R 12/91* (2013.01); *H01R 13/28* (2013.01); *H01R 13/5202* (2013.01); *H01R 13/6315* (2013.01); *H01R 24/66* (2013.01)

(58) Field of Classification Search
CPC ... H01R 13/6315; H01R 12/91; H01R 13/38
USPC ..... 439/246, 247, 248
See application file for complete search history.

(56) References Cited

U.S. PATENT DOCUMENTS

| | | | | |
|---|---|---|---|---|
| 6,695,632 | B2 | 2/2004 | Matsumoto et al. | |
| 7,789,690 | B1 | 9/2010 | Rhein | |
| 8,632,351 | B2 * | 1/2014 | Wu | H01R 13/6315 439/248 |
| 8,747,157 | B2 * | 6/2014 | Tashiro | H01R 13/4364 439/246 |
| 8,951,065 | B2 * | 2/2015 | Tsuge | H01R 13/631 439/559 |
| 9,039,452 | B2 | 5/2015 | Sakaizawa et al. | |

FOREIGN PATENT DOCUMENTS

| | | | |
|---|---|---|---|
| JP | H05-198330 | A | 8/1993 |
| JP | 2002-313496 | A | 10/2002 |
| JP | 2002-373737 | A | 12/2002 |
| JP | 2003-323932 | A | 11/2003 |
| JP | 2009-093896 | A | 4/2009 |
| JP | 2012-079413 | A | 4/2012 |
| JP | 2013-507734 | A | 3/2013 |
| JP | 2013-229154 | A | 11/2013 |

* cited by examiner

*Primary Examiner* — Abdullah Riyami
*Assistant Examiner* — Justin Kratt
(74) *Attorney, Agent, or Firm* — Collard & Roe, P.C.

(57) ABSTRACT

A connector is mateable with a mating connector along a mating direction. The connector comprises a stationary housing, a movable housing and a cable member. The movable housing is movable relative to the stationary housing in a predetermined plane perpendicular to the mating direction. The cable member includes a contact, a terminal and a wire. The contact is held by the movable housing. The wire includes core wires which are helically twisted together. One of opposite ends of the wire is fixed to the contact, and a remaining one of the opposite ends of the wire is fixed to the terminal. The movable housing has a regulation portion. The contact has a regulated portion. The regulation portion regulates a rotation of the regulated portion in the predetermined plane.

16 Claims, 18 Drawing Sheets

CONNECTOR HAVING A FLOATING STRUCTURE

CROSS REFERENCE TO RELATED APPLICATIONS

An applicant claims priority under 35 U.S.C. §119 of Japanese Patent Application No. JP2015-102941 filed May 20, 2015.

BACKGROUND OF THE INVENTION

This invention relates to a connector having a floating structure.

For example, this type of connector is disclosed in JP A 2013-229154 (Patent Document 1), the content of which is incorporated herein by reference.

Referring to FIG. 29, Patent Document 1 discloses three connection members (connectors) 910 and three power connectors (mating connectors) 950 which correspond to the connection members 910, respectively. Each of the connection members 910 comprises a housing member 912 which holds braided wires 914. The housing member 912 is attached to a panel (object) 920 and is movable along a predetermined plane (XZ-plane) in parallel to a surface of the panel 920. In other words, the connection member 910 has a floating structure. In contrast, the power connectors 950 are fixed to three power unit (mating object) 960, respectively. Even in a case where an arrangement of the housing members 912 in the XZ-plane is slightly different from another arrangement of the power connectors 950 in the XZ-plane, the floating structure of the connection member 910 enables the connection member 910 to be mated with the corresponding power connector 950.

As can be seen from FIG. 29, the braided wire 914 is hard to be deformed in a pitch direction (X-direction) in spite of its flexibility. Because of this reason, the housing 912 might be unsmoothly moved in the X-direction. In other words, the floating structure of the connection member 910 does not effectively work in some cases.

SUMMARY OF THE INVENTION

It is therefore an object of the present invention to provide a connector having a floating structure which effectively works in each of two directions perpendicular to a mating direction even under a state where the connector is connected to a wire.

An aspect of the present invention provides a connector mateable with a mating connector along a mating direction. The connector comprises a stationary housing, a movable housing and a cable member. The movable housing is movable relative to the stationary housing in a predetermined plane perpendicular to the mating direction. The cable member includes a contact, a terminal and a wire. The contact is held by the movable housing. The wire includes core wires which are helically twisted together. One of opposite ends of the wire is fixed to the contact, and a remaining one of the opposite ends of the wire is fixed to the terminal. The movable housing has a regulation portion. The contact has a regulated portion. The regulation portion regulates a rotation of the regulated portion in the predetermined plane.

According to the present invention, the wire of the connector includes the core wires which are helically twisted together. Slightly untwisting of the core wires improves the flexibility of the wire. This improvement enables the movable housing holding the wire to be smoothly moved in the predetermined plane. In other words, the floating structure of the connector effectively works in each of two directions perpendicular to the mating direction.

An appreciation of the objectives of the present invention and a more complete understanding of its structure may be had by studying the following description of the preferred embodiment and by referring to the accompanying drawings.

Figure 1:
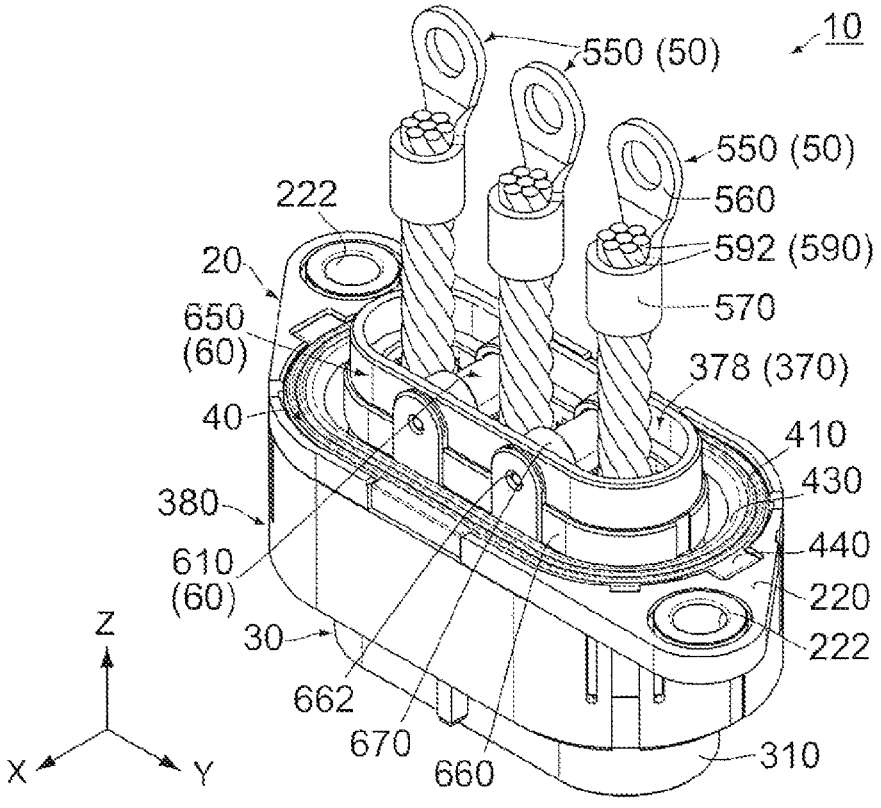
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
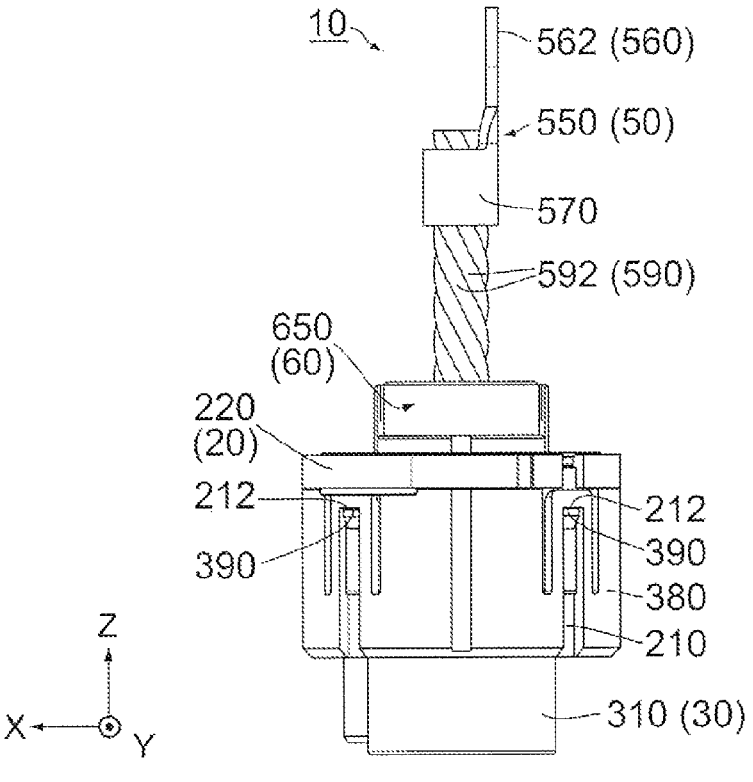
FIG. 2 is a front view showing the connector of FIG. 1.
Figure 3:
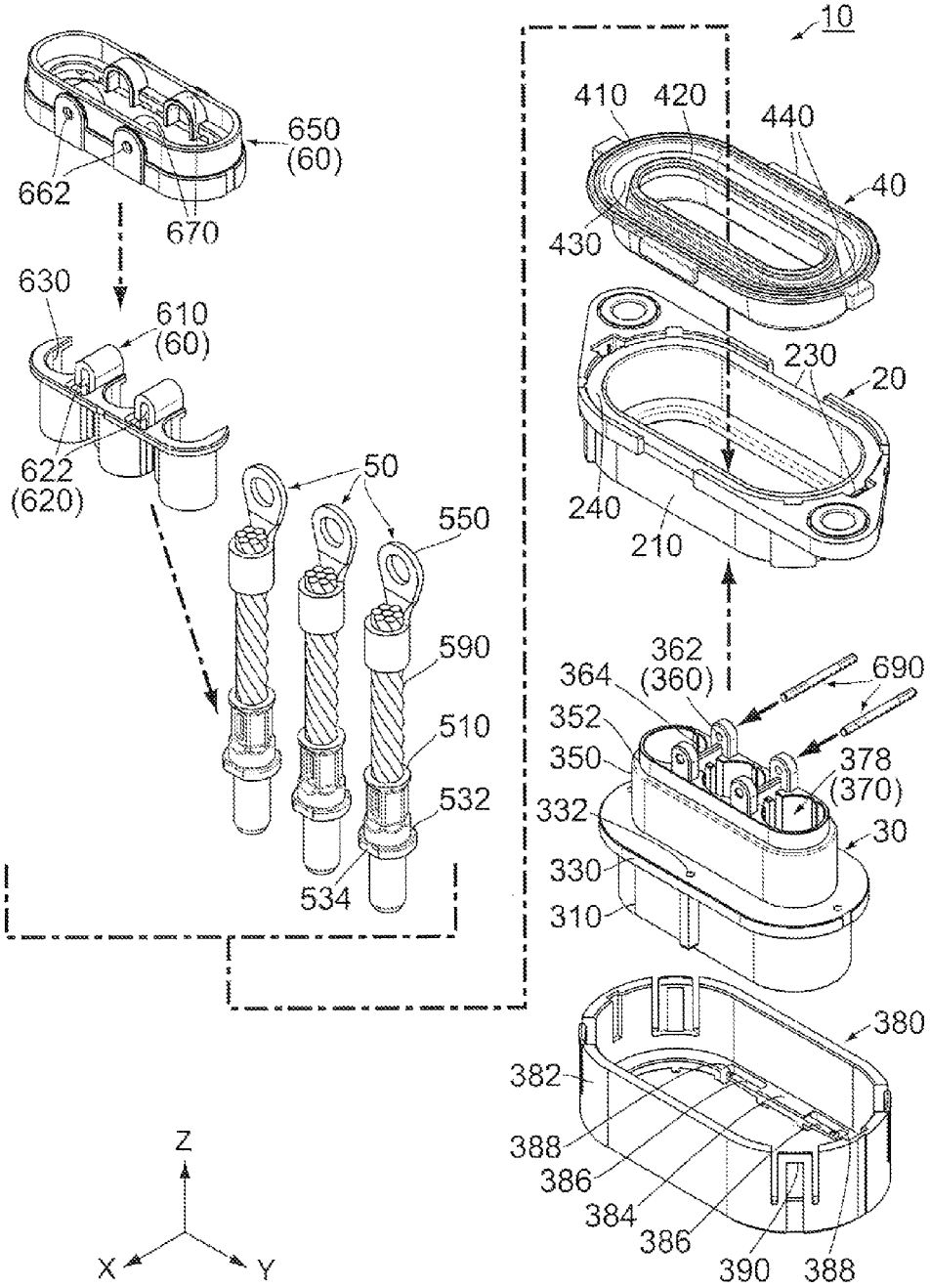
FIG. 3 is an exploded, perspective view showing the connector of FIG. 1.

As shown in FIGS. 1 to 3, a connector 10 according to an embodiment of the present invention is formed of members combined together as described later and has a shape which is short in a width direction (X-direction) and long in a pitch direction (front-rear direction: Y-direction). However, the present invention is not limited thereto. The present invention is applicable to various connectors.

Figure 22:
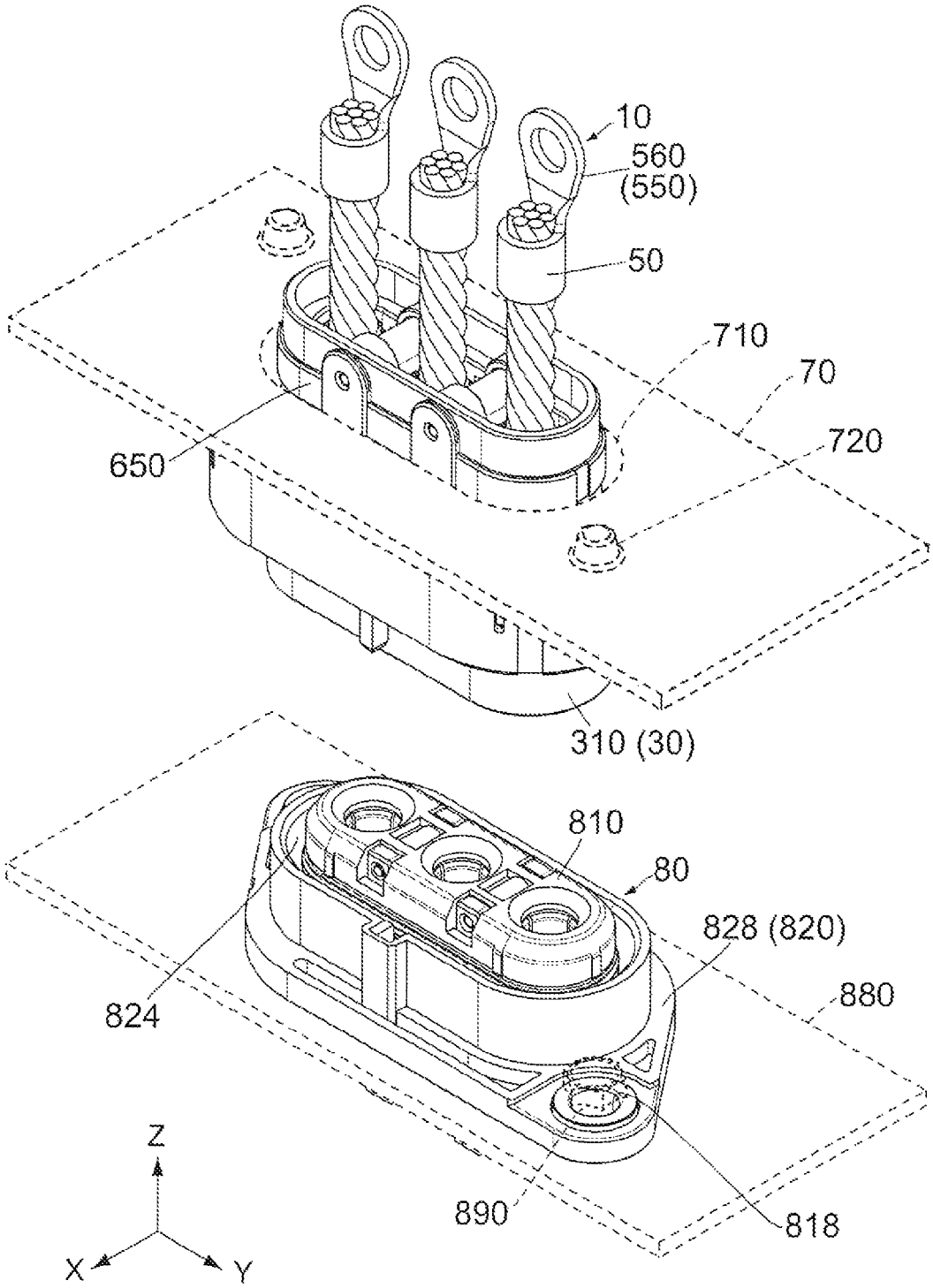
FIG. 22 is a perspective view showing the connector of FIG. 1 and the mating connector of FIG. 20, wherein the connector and the mating connector are in an unmated state, and as shown by dashed line, the connector is fixed to a case by screws, and the mating connector is fixed to a mating case by screws.
Figure 23:
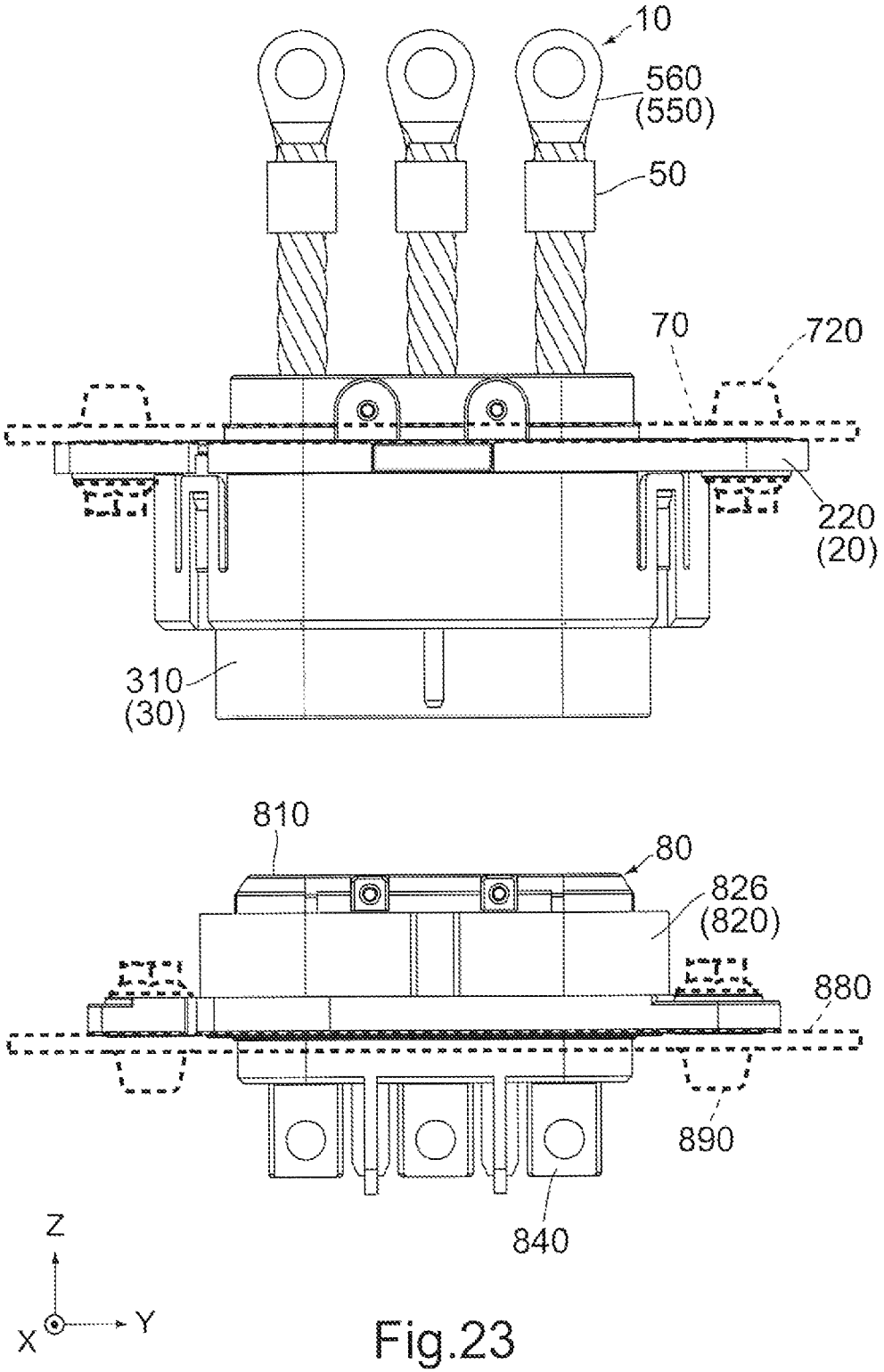
FIG. 23 is a side view showing the connector and the mating connector of FIG. 22.
Figure 24:
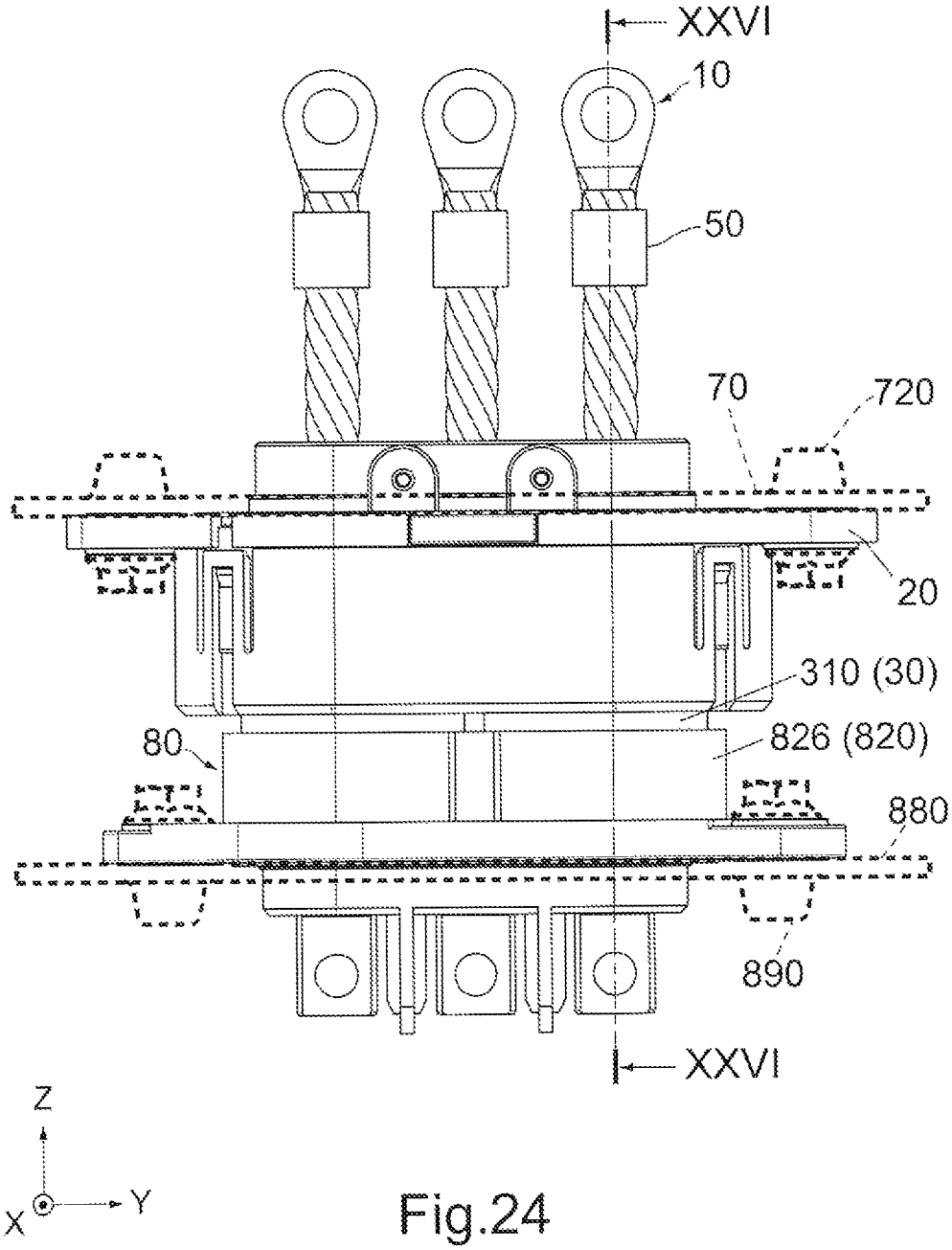
FIG. 24 is a side view showing the connector and the mating connector of FIG. 23, wherein the connector and the mating connector are in a mated state.

Referring to FIGS. 22 to 24, the connector 10 according to the present embodiment is to be fixed to an object (case) 70 and used to transmit or receive electric power to or from a mating connector 80. The case 70 is, for example, an outer shell of an inverter system in an electric car. In addition, the connector 10 is a waterproof connector. However, the present invention is not limited thereto. For example, the present invention is also applicable to a connector other than the connector in the electric car. Moreover, the present invention is applicable to a connector with no waterproof structure.

The mating connector 80 is fixed to a mating object (mating case) 880 when used. The mating case 880 is, for example, an outer shell of a motor system in the electric car. The connector 10 fixed to the case 70 is mateable with the mating connector 80 fixed to the mating case 880 along a mating direction (up-down direction: Z-direction). Moreover, the connector 10 is removable from the mating connector 80 along the Z-direction.

Figure 20:
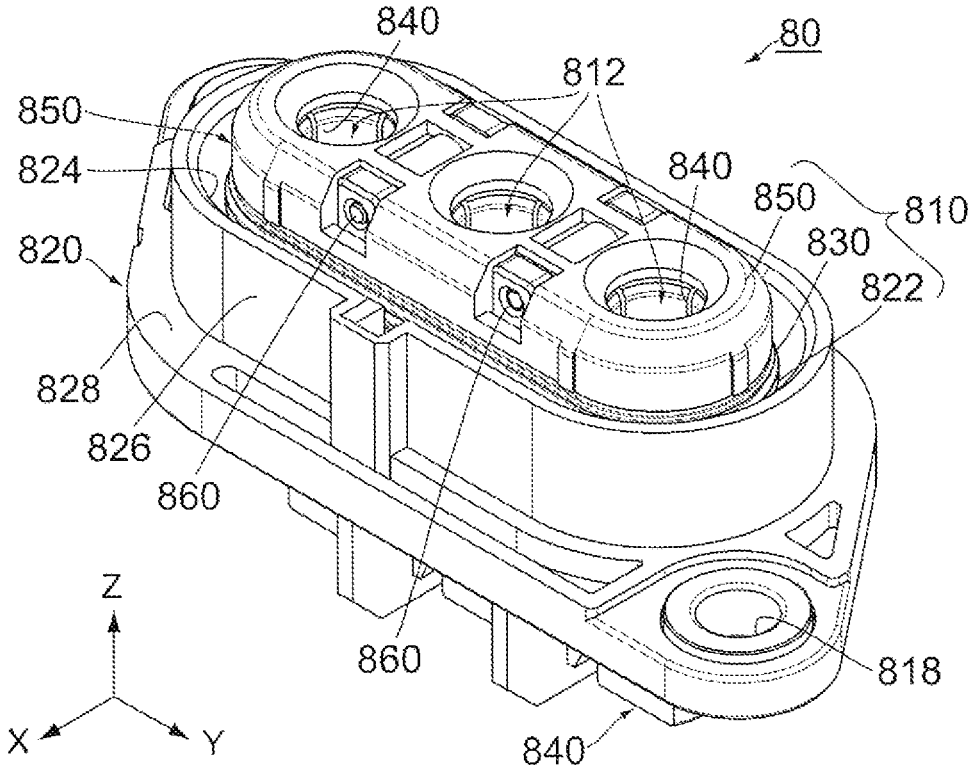
FIG. 20 is a perspective view showing a mating connector mateable with the connector of FIG. 1.
Figure 21:
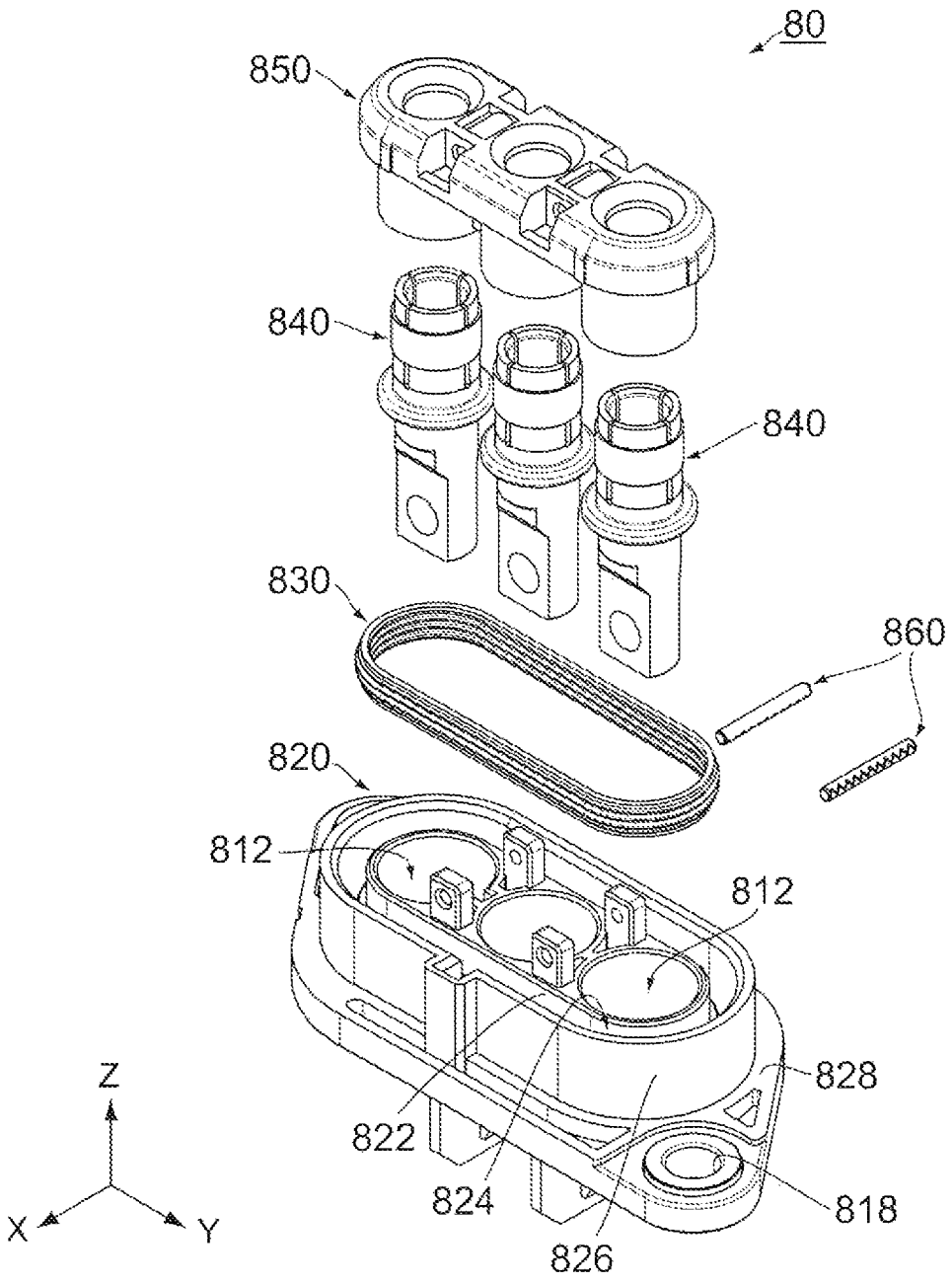
FIG. 21 is an exploded, perspective view showing the mating connector of FIG. 20.

As shown in FIGS. 20 and 21, the mating connector 80 according to the present embodiment comprises a mating housing 820 made of insulator, a mating sealing member 830 made of elastomer, three mating contacts 840 each made of metal, a cap 850 made of insulator and two spring pins 860 each made of metal. According to the present embodiment, the mating connector 80 is a waterproof connector. However, the present invention is not limited thereto. The mating connector 80 may have no waterproof structure.

The mating housing 820 has an island portion 822, a recessed portion 824, an outer wall 826 and a flange 828. The island portion 822 projects upward, or in the positive Z-direction, from a bottom portion of the mating housing 820. The recessed portion 824 is a space which encloses the island portion 822 in a predetermined plane, or in the XY-plane. The outer wall 826 encloses the recessed portion 824 in the XY-plane. The flange 828 protrudes outward in the XY-plane from the outer wall 826.

The mating sealing member 830 is attached to the mating housing 820 so as to be fastened around a predetermined part of the island portion 822, wherein the predetermined part is located in the vicinity of an upper end, or the positive Z-side end, of the island portion 822. The cap 850 is attached to the upper end of the island portion 822. The cap 850 is fixed to the mating housing 820 by the spring pins 860 and prevents the mating sealing member 830 from coming off.

Referring to FIG. 20, the mating connector 80 comprises a mating fit portion 810, three receiving portions 812 and two mating fixed portions 818. The mating fit portion 810 is formed of the island portion 822, the mating sealing member 830 and the cap 850. Each of the receiving portions 812 is a space which opens both upward and downward (in the negative Z-direction). The receiving portions 812 are provided to the mating fit portion 810 and arranged in the Y-direction. The receiving portions 812 receive and hold the mating contacts 840, respectively. Each of the mating contacts 840 has a lower end (the negative Z-side end) which passes through the corresponding receiving portion 812 and projects outward from the mating housing 820. Each of the mating fixed portions 818 is a hole which pierces the flange 828 in the Z-direction.

Referring to FIGS. 20 and 22, the mating case 880 is formed with an attachment hole (not shown) which pierces the mating case 880 in the Z-direction. The mating fixed portions 818 are fixed to the mating case 880 by screws 890 when the mating connector 80 is used. By this fixing, the mating connector 80 is attached to the mating case 880 so as not to be moved relative to the mating case 880. Under a state where the mating connector 80 is thus attached to the mating case 880, an upper part (the positive Z-side part) of the mating connector 80 including the flange 828 is located above the mating case 880, and a lower part (the negative Z-side part) of the mating connector 80 passes through the attachment hole and is located inside of the mating case 880, for example, inside of the inverter system. Under this state, the lower ends of the mating contacts 840 are connected to a mating connection object (not shown).

Referring to FIGS. 1 to 3, the connector 10 according to the present embodiment comprises a stationary housing 20 made of insulator, a movable housing 30 made of insulator, a support member 380 made of insulator, a sealing member 40 made of elastomer, three cable members 50, a fixing member 60 and two spring pins 690 each made of metal.

Figure 4:
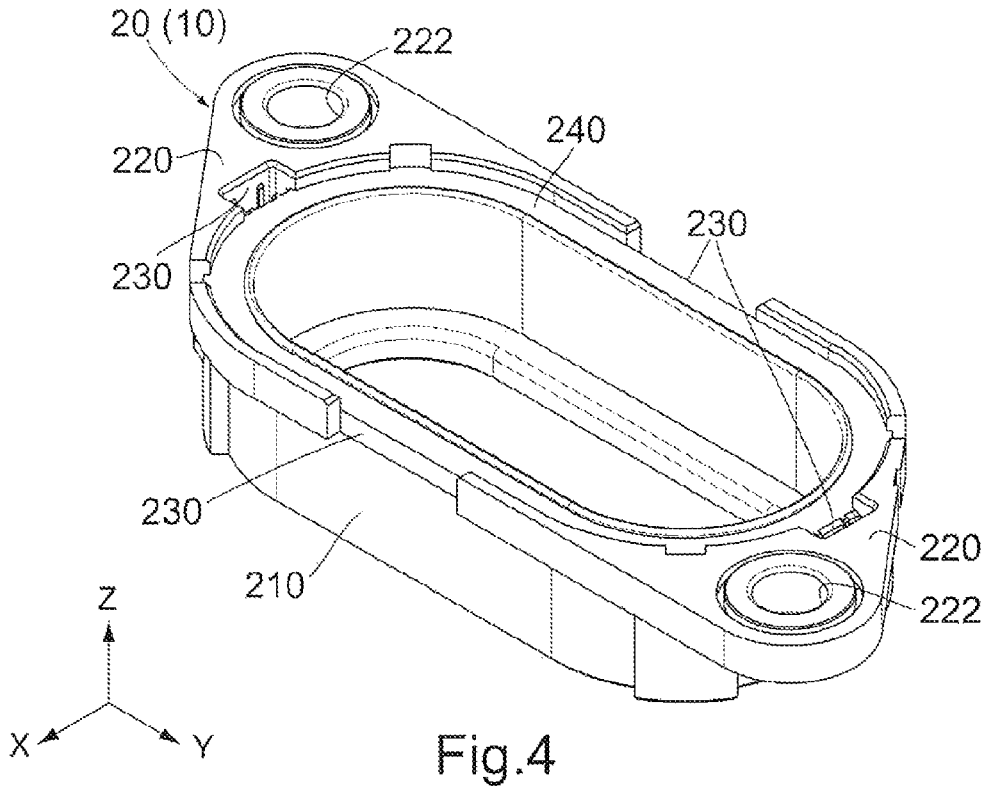
FIG. 4 is a perspective view showing a stationary housing of the connector of FIG. 3.

As shown in FIG. 4, the stationary housing 20 has a body portion 210 and a flange 220. The body portion 210 has a racetrack shape in the XY-plane and is long in the Y-direction. The flange 220 protrudes outward in the XY-plane from an upper end of the body portion 210.

Referring to FIG. 2, the body portion 210 is formed with four engagement portions 212. Two of the engagement portions 212 generally project forward, or in the positive Y-direction, from the positive Y-side part (front part) of the body portion 210, and remaining two (not shown) of the engagement portions 212 generally project rearward, or in the negative Y-direction, from the negative Y-side part (rear part) of the body portion 210. Referring together with FIGS. 26 and 27, the body portion 210 has a lower end formed with a lower surface (slide surface) 214. The slide surface 214 is a flat plane in parallel to the XY-plane. In other words, the slide surface 214 of the stationary housing 20 is smooth.

As shown in FIG. 4, the stationary housing 20 has two fixed portions 222, four attachment portions 230 and a fixing portion 240. Each of the fixed portions 222 is a hole which pierces the flange 220 in the Z-direction. The fixing portion 240 is a ditch which is formed at a boundary between the body portion 210 and the flange 220. The fixing portion 240 is recessed downward and has a racetrack shape in the XY-plane. The fixing portion 240 has a smooth bottom surface which is looped with no break. The attachment portions 230 are provided around the fixing portion 240 in the XY-plane. Two of the attachment portions 230 are holes each of which pierces the flange 220 in the Z-direction, wherein the fixing portion 240 is located between the holes in the Y-direction. Remaining two of the attachment portions 230 are cut portions each of which partially cuts the flange 220, wherein the fixing portion 240 is located between the cut portions in the X-direction.

Figure 5:
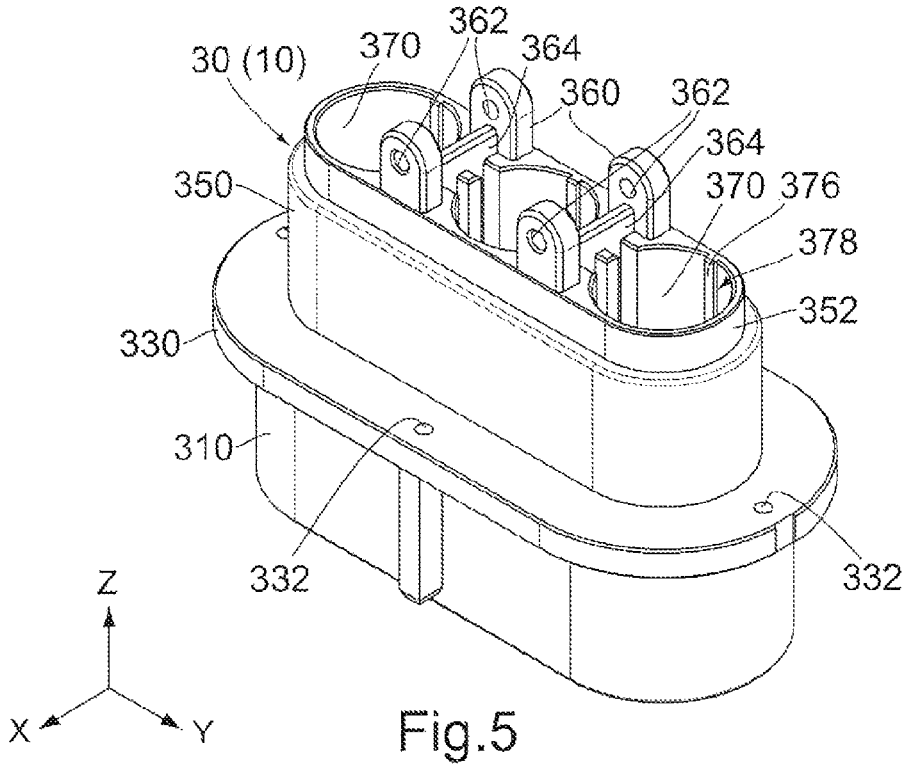
FIG. 5 is a perspective view showing a movable housing of the connector of FIG. 3.
Figure 6:
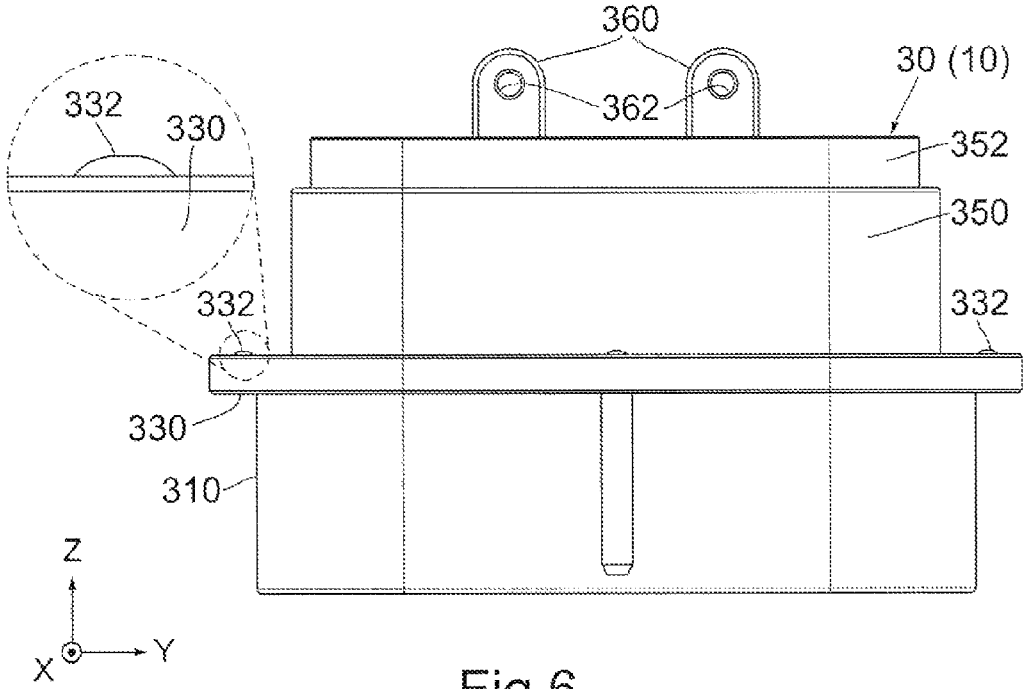
FIG. 6 is a side view showing the movable housing of FIG. 5, wherein the vicinity of a slidable projection on a supported portion (the part encircled by dashed line) is enlarged to be illustrated.
Figure 10:
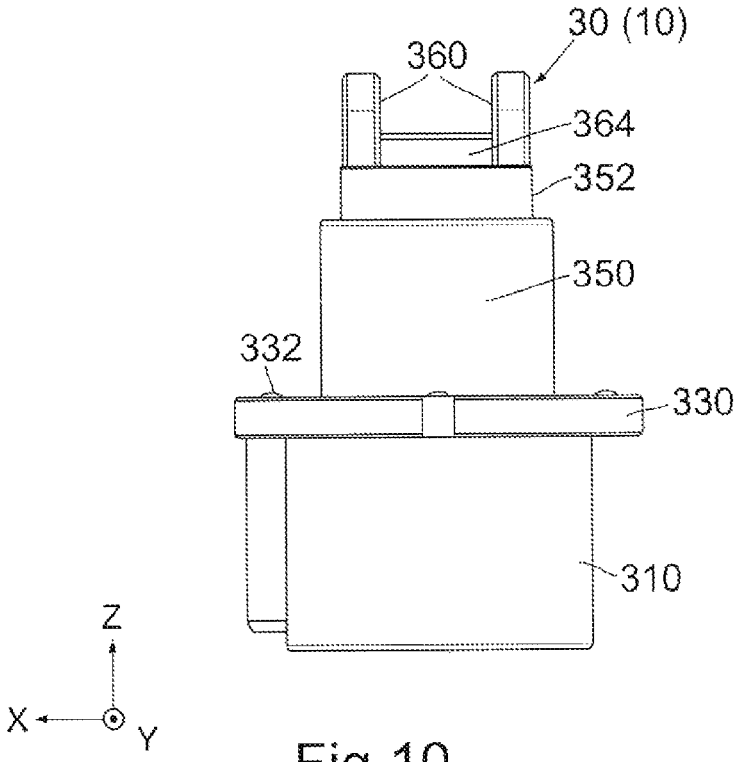
FIG. 10 is a front view showing the movable housing of FIG. 5.

As shown in FIGS. 5, 6 and 10, the movable housing 30 has a fit portion 310, a supported portion 330 and an opposite portion 350. Each of the fit portion 310 and the opposite portion 350 has a racetrack shape in the XY-plane and is long in the Y-direction. The fit portion 310 is located below the supported portion 330, while the opposite portion 350 is located above the supported portion 330. The supported portion 330 protrudes outward in the XY-plane from a boundary between the fit portion 310 and the opposite portion 350.

Figure 7:
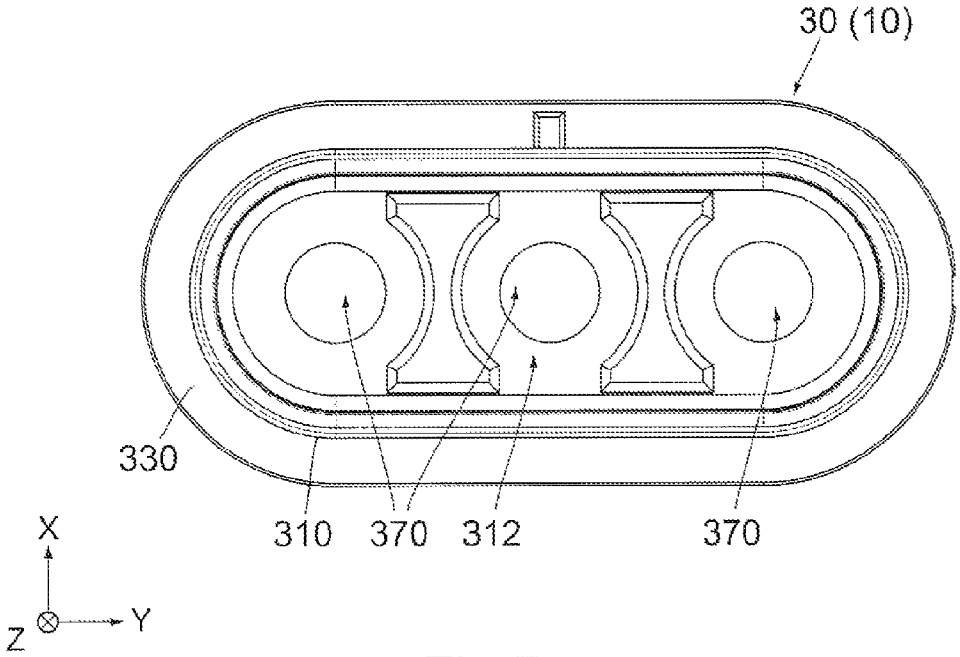
FIG. 7 is a bottom view showing the movable housing of FIG. 5.
Figure 8:
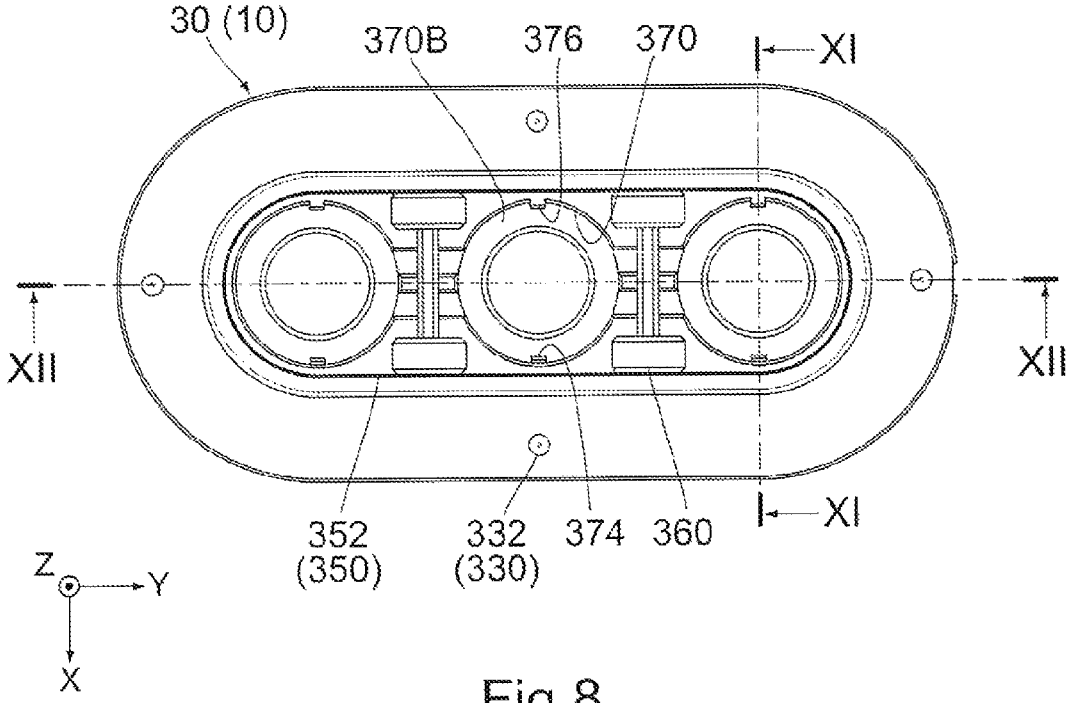
FIG. 8 is a top view showing the movable housing of FIG. 5.
Figure 11:
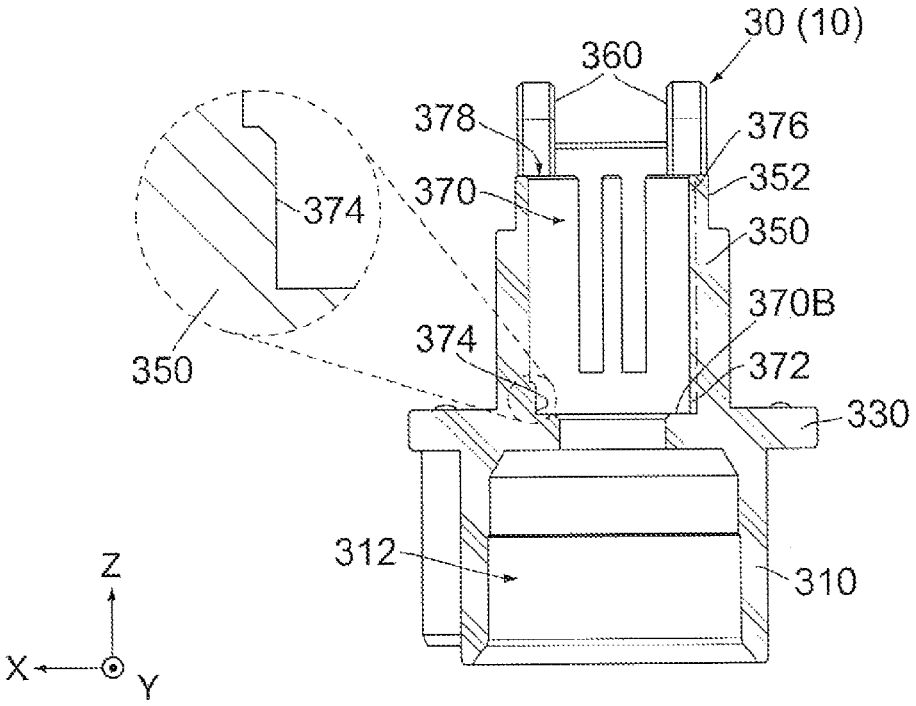
FIG. 11 is a cross-sectional view showing the movable housing of FIG. 8, taken along line XI-XI, wherein an imaginary boundary line, which separates a first regulation portion and a guide portion from an inner wall of the receiving portion, is illustrated by chain dotted line, and the vicinity of a second regulation portion (the part encircled by dashed line) is enlarged to be illustrated.
Figure 12:
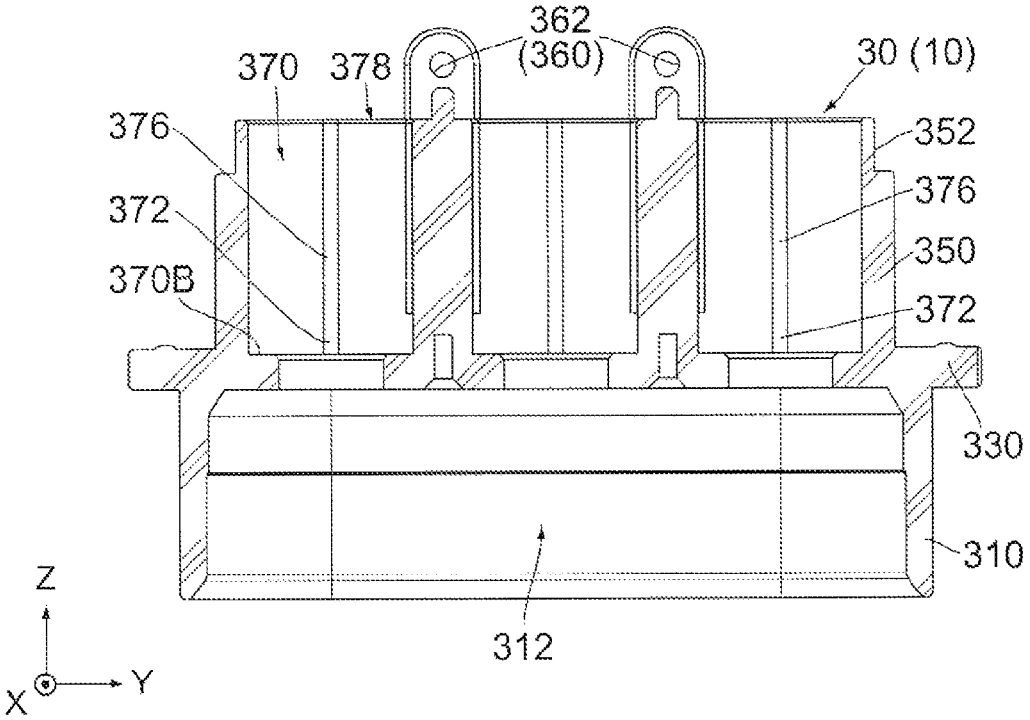
FIG. 12 is a cross-sectional view showing the movable housing of FIG. 8, taken along line XII-XII.

As shown in FIGS. 7, 11 and 12, the fit portion 310 has an accommodation portion 312. The accommodation portion 312 is a space formed inside of the fit portion 310. As shown in FIGS. 6, 8 and 10, the supported portion 330 has four slidable projections 332. The slidable projections 332 are formed on an upper surface (the positive Z-side surface) of the supported portion 330 and project upward. The slidable projections 332 are provided around the opposite portion 350 in the XY-plane. In detail, two of the slidable projections 332 locate the opposite portion 350 therebetween in the Y-direction, and remaining two of the slidable projections 332 locate the opposite portion 350 therebetween in the X-direction. Each of the slidable projections 332 has an upper surface which is smooth and small. The opposite portion 350 has a fixing portion 352. In detail, the opposite portion 350 has an upper end which is recessed inward in the XY-plane so that the fixing portion 352 is formed. The fixing portion 352 is a curved smooth surface which is looped with no break in the XY-plane.

Referring to FIGS. 5, 6 and 10, the movable housing 30 has four projecting portions 360 and two projecting walls 364. The projecting portions 360 project upward from the upper end of the opposite portion 350. Two of the projecting portions 360 are located at the positive Y-side (front side) of the movable housing 30 and face each other in the X-direction, and remaining two of the projecting portions 360 are located at the negative Y-side (rear side) of the movable housing 30 and face each other in the X-direction. One of the projecting walls 364 extends between the two positive Y-side projecting portions 360, and a remaining one of the projecting walls 364 extends between the two negative Y-side projecting portions 360.

Each of the projecting portions 360 of the movable housing 30 is formed with an insertion portion 362. The insertion portion 362 is a hole which pierces the projecting portion 360 in the X-direction. The positive Y-side two of the insertion portions 362 are located at positions same as each other in the YZ-plane. Similarly, the negative Y-side two of the insertion portions 362 are located at positions same as each other in the YZ-plane.

As shown in FIGS. 5, 7 and 8, the movable housing 30 has three receiving portions 370. The receiving portions 370 are provided to the opposite portion 350 and arranged in the Y-direction. Each of the receiving portions 370 is a space which opens both upward and downward. In detail, each of the receiving portions 370 has an opening 378 located at an end, or an upper end, thereof in the Z-direction. Moreover, each of the receiving portions 370 has a lower part which communicates with the accommodation portion 312.

Figure 9:
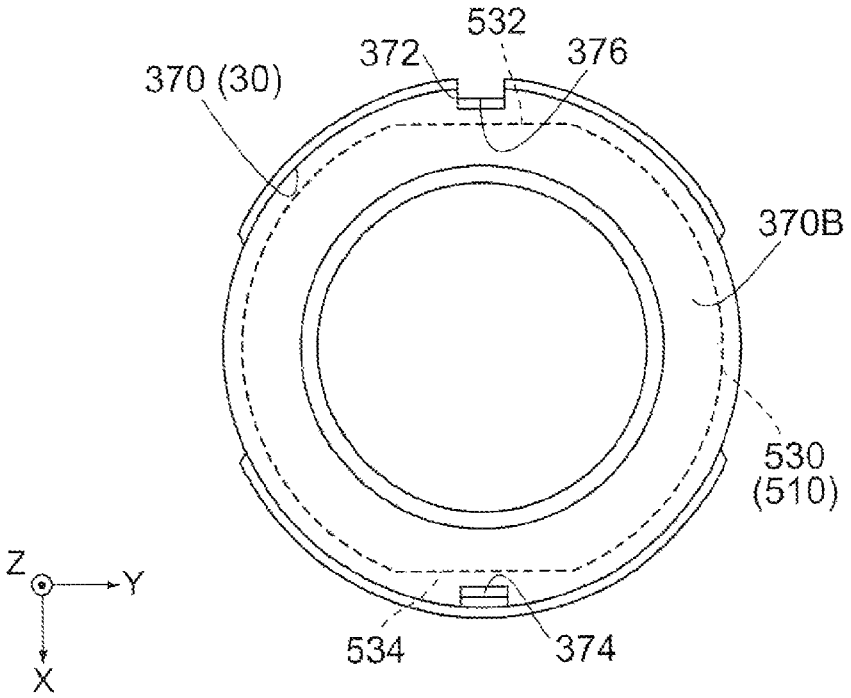
FIG. 9 is an enlarged, top view showing a receiving portion of the movable housing of FIG. 8, wherein an outline of a received portion of a contact inserted in the receiving portion is illustrated by dashed line.

Referring to FIGS. 9, 11 and 12, each of the receiving portions 370 is provided with a bottom surface 370B, a first regulation portion (regulation portion) 372, a second regulation portion (regulation portion) 374 and a guide portion 376 which are formed within the receiving portion 370. In other words, the movable housing 30 has the two regulation portions 372 and 374, namely, the first regulation portion 372 and the second regulation portion 374, and the guide portion 376 for each of the receiving portions 370.

The bottom surface 370B encloses an opening, which is a lower end of the receiving portion 370, in the XY-plane. Each of the first regulation portion 372, the second regulation portion 374 and the guide portion 376 is a rectangular column-like portion, wherein the rectangular column-like portion is provided to an inner wall enclosing the receiving portion 370 and projects toward the center of the receiving portion 370 in the XY-plane. The first regulation portion 372 and the second regulation portion 374 face each other in the X-direction.

In detail, the first regulation portion 372 extends upward from the negative X-side part of the bottom surface 370B, and the second regulation portion 374 extends upward from the positive X-side part of the bottom surface 370B. The guide portion 376 continuously extends from the first regulation portion 372 toward the opening 378 of the receiving portion 370. In particular, the guide portion 376 of the present embodiment is integrally formed with the first regulation portion 372 and extends to the opening 378. In other words, each of the first regulation portion 372 and the guide portion 376 is a part of the rectangular column-like portion which continuously extends between the bottom surface 370B and the opening 378. In contrast, the second regulation portion 374 is provided with no guide portion.

Figure 26:
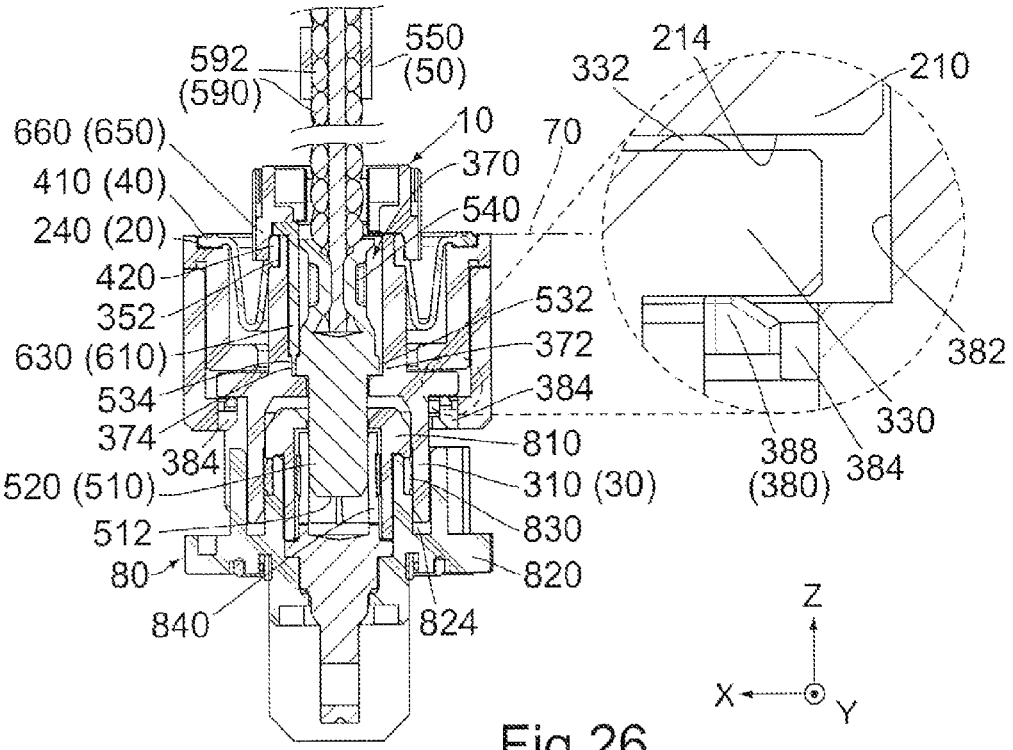
FIG. 26 is a cross-sectional view showing the connector and the mating connector of FIG. 25, taken along line XXVI-XXVI, wherein the vicinity of the slidable projection (the part encircled by dashed line) is enlarged to be illustrated, and a part of an outline of a lower surface of the case is illustrated by chain dotted line.
Figure 27:
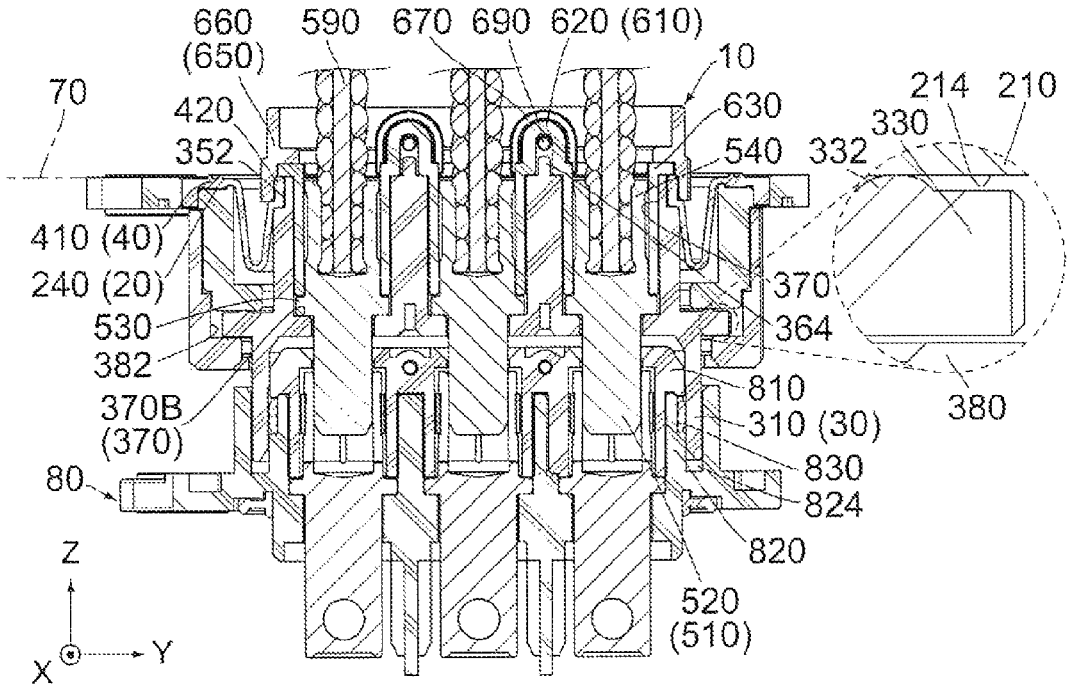
FIG. 27 is a cross-sectional view showing the connector and the mating connector of FIG. 25, taken along line XXVII-XXVII, wherein the vicinity of the slidable projection (the part encircled by dashed line) is enlarged to be illustrated, and a part of the outline of the lower surface of the case is illustrated by chain dotted line.

Referring to FIGS. 1 and 3, the opposite portion 350 of the movable housing 30 is inserted in the body portion 210 of the stationary housing 20 from below. Referring to FIGS. 26 and 27, the slidable projections 332 of the thus-inserted movable housing 30 are located under the slide surface 214 of the stationary housing 20.

Figure 13:
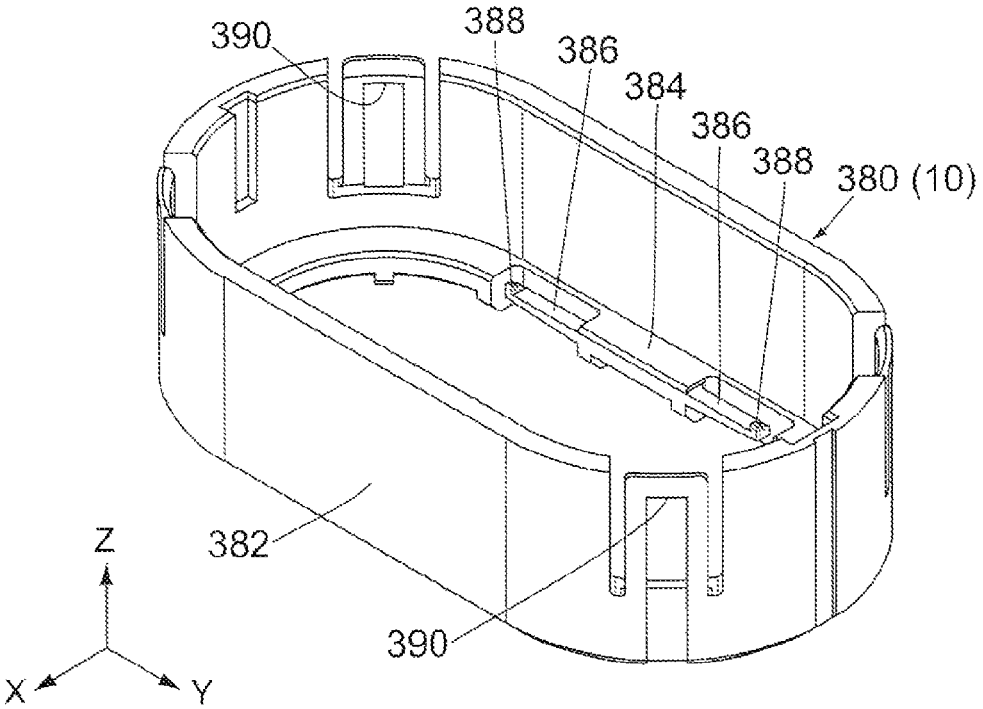
FIG. 13 is a perspective view showing a support member of the connector of FIG. 3.

Referring to FIGS. 13 and 26, the support member 380 has a body portion 382 and two protruding portions 384. The body portion 382 has a racetrack shape in the XY-plane and is long in the Y-direction. The body portion 382 has a lower end which partially protrudes into the inside of the body portion 382 so that the protruding portions 384 are formed. The protruding portions 384 are located at opposite sides of the body portion 382 in the X-direction, respectively.

Each of the protruding portions 384 is formed with two support portions 386. One of the support portions 386 extends forward, or in the positive Y-direction, from the protruding portion 384, and a remaining one of the support portions 386 extends rearward, or in the negative Y-direction, from the protruding portion 384. Each of the support portions 386 has a fixed end and a free end, wherein the fixed end is fixed to the protruding portion 384, and the free end is movable mainly in the Z-direction. Each of the support portions 386 is formed with a support projection 388. The support projection 388 is formed on an upper surface of the support portion 386 and projects upward. The support projection 388 is located in the vicinity of the free end of the support portion 386 and is movable in the Z-direction because of the resilient deformation of the support portion 386. Each of the support projections 388 has a flat and small upper surface.

Referring to FIG. 13, the body portion 382 has four engaged portions 390. Each of the engaged portions 390 is an inner edge of a U-like shape spring piece formed as a part of the body portion 382. Referring to FIG. 2, the engaged portions 390 are provided to be located at positions which correspond to those of the engagement portions 212 of the stationary housing 20, respectively.

Referring to FIGS. 2 and 3, the support member 380 is attached to the stationary housing 20 from below. In detail, the engaged portions 390 of the support member 380 are engaged with the engagement portions 212 of the stationary housing 20, respectively, so that the support member 380 is attached to the stationary housing 20. Under a state where the support member 380 is thus attached to the stationary housing 20, the support member 380 supports the movable housing 30 from below and covers the fit portion 310 of the movable housing 30 in the XY-plane. Provided that the movable housing 30 can be thus supported, any number of engaged portions 390 and the engagement portions 212 may be provided in any arrangement.

Referring to FIGS. 26 and 27, the upper ends of the slidable projections 332 of the supported portion 330 of the movable housing 30 are in contact with the slide surface 214 of the stationary housing 20. Moreover, a lower surface of the supported portion 330 is in contact with the upper ends of the support projections 388 of the support member 380. In other words, the movable housing 30 is supported from below only by the upper ends of the four support projections 388 and is in contact with the slide surface 214 only at the upper ends of the four slidable projections 332, wherein, the support projections 388 are movable in the Z-direction. The supported portion 330 therefore does not receive a large force while being securely sandwiched between the support projections 388 and the slide surface 214 in the Z-direction so that a vertical movement thereof is regulated.

As can be seen from the aforementioned support structure, the slidable projections 332 are capable of sliding on the slide surface 214, so that the movable housing 30 can be smoothly moved relative to the stationary housing 20 in the XY-plane (predetermined plane). In other words, the connector 10 has a floating structure. However, the connector 10 may have another floating structure based on another support structure different from that of the present embodiment.

Referring to FIGS. 26 and 27, the supported portion 330 of the movable housing 30 is located inside of the body portion 382 of the support member 380, and a size of the cross-section of the supported portion 330 in the XY-plane is smaller than another size of the inside space of the body portion 382 in the XY-plane. The movable housing 30 according to the present embodiment is therefore floatingly movable only within a range which is defined by a gap between the supported portion 330 and the body portion 382. However, the present invention is not limited thereto. The movable housing 30 may be floatingly movable in a wider range.

Figure 14:
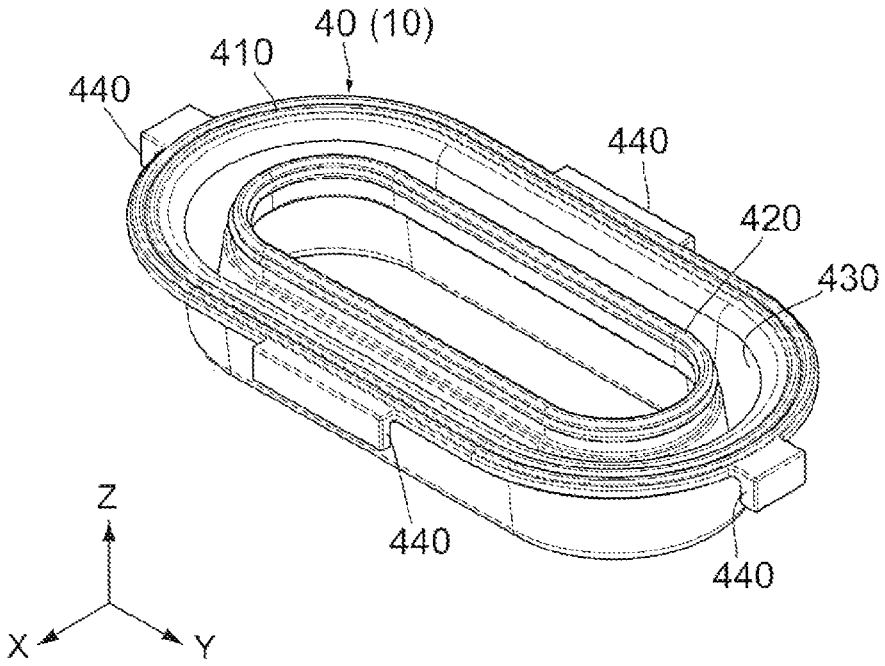
FIG. 14 is a perspective view showing a sealing member of the connector of FIG. 3.

As shown in FIG. 14, the sealing member 40 has a racetrack shape in the XY-plane and is long in the Y-direction. The sealing member 40 has a first fixed portion 410, a second fixed portion 420, a middle portion 430 and four attached portions 440.

The first fixed portion 410 is provided to an outer circumference of the sealing member 40 in the XY-plane. The first fixed portion 410 protrudes outward in the XY-plane from the middle portion 430. The second fixed portion 420 is provided to an inner circumference of the sealing member 40 in the XY-plane. The second fixed portion 420 projects upward from the middle portion 430.

The middle portion 430 couples the first fixed portion 410 and the second fixed portion 420 with each other. In detail, the middle portion 430 extends downward from the first fixed portion 410 while being gradually narrowed, or shrinking inward, in the XY-plane, and subsequently extends upward to the second fixed portion 420 while being gradually narrowed, or shrinking inward. The first fixed portion 410 is connected to the second fixed portion 420 via the middle portion 430 with no break in a cross-section in parallel to the Z-direction, for example, in the XZ-plane or in the YZ-plane. The middle portion 430 is looped with no break in a plane perpendicular to the Z-direction, or in the XY-plane.

The attached portions 440 according to the present embodiment are provided to be located around the first fixed portion 410 in the XY-plane. Each of the attached portions 440 has a hook, or has a hook-like shape in a plane in parallel to the Z-direction. In detail, two of the attached portions 440 have the respective hooks in the YZ-plane and locate the first fixed portion 410 therebetween in the Y-direction. Remaining two of the attached portions 440 have the respective hooks in the XZ-plane and locate the first fixed portion 410 therebetween in the X-direction.

Figure 25:
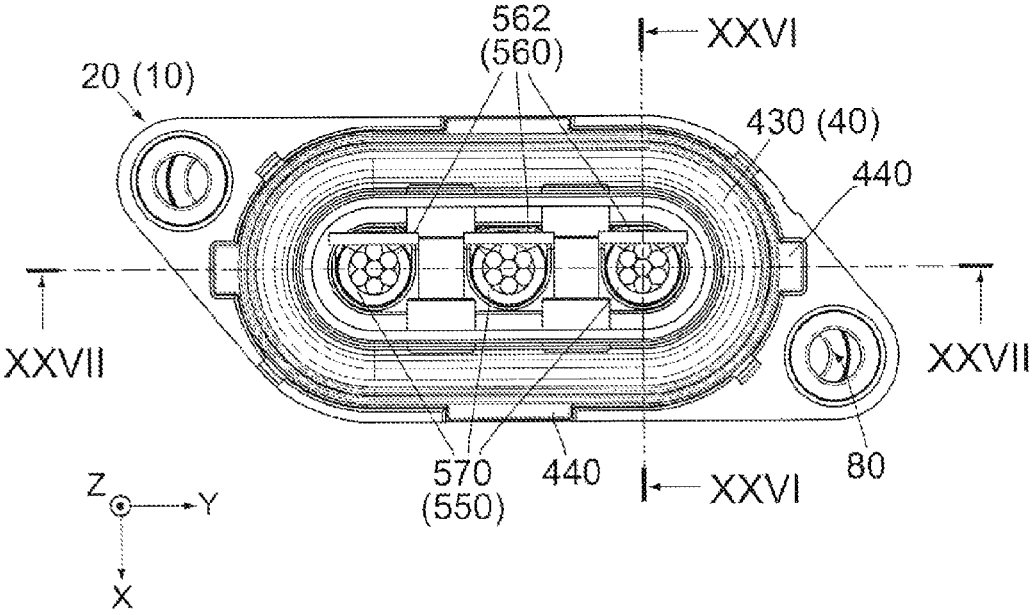
FIG. 25 is a top view showing the connector and the mating connector of FIG. 24, wherein the case, the mating case and the screws are not illustrated.

Referring to FIGS. 3 and 25, the sealing member 40 is attached to the stationary housing 20 and the movable housing 30 from above. In detail, the hooks of the attached portions 440 are inserted into the attachment portions 230, respectively, so that the sealing member 40 is positioned relative to the stationary housing 20 in the XY-plane. In addition, the first fixed portion 410 is fit into and held by the fixing portion 240 of the stationary housing 20. Provide that the first fixed portion 410 can be securely held by the fixing portion 240 as described above, any number of the attached portions 440 and the attachment portions 230 may be provided in any arrangement. The second fixed portion 420 of the sealing member 40 is attached to the movable housing 30 so as to be fastened around the fixing portion 352 of the movable housing 30. As a result, the first fixed portion 410 of the sealing member 40 is fixed to the stationary housing 20, and the second fixed portion 420 is fixed to the movable housing 30.

As can be seen from the aforementioned structure of the sealing member 40, the second fixed portion 420 is movable in the XY-plane relative to the first fixed portion 410. In particular, the sealing member 40 of the present embodiment is wholly made of elastomer such as waterproof rubber so that the middle portion 430 is easy to be elastically deformed. Moreover, under a state where the sealing member 40 is not elastically deformed, a thickness of the middle portion 430 is smaller than a thickness, or the maximum size in the Z-direction, of the first fixed portion 410 and is smaller than a thickness, or the maximum size in a plane perpendicular to the Z-direction, of the second fixed portion 420. In other words, the middle portion 430 is thinner than both the first fixed portion 410 and the second fixed portion 420. Because of this structure, the middle portion 430 is easier to be elastically deformed, so that the second fixed portion 420 fixed to the movable housing 30 is easy to be moved in the XY-plane relative to the first fixed portion 410 fixed to the stationary housing 20. The sealing member 40 therefore does not affect the floating movement of the movable housing 30 in the XY-plane.

Figure 15:
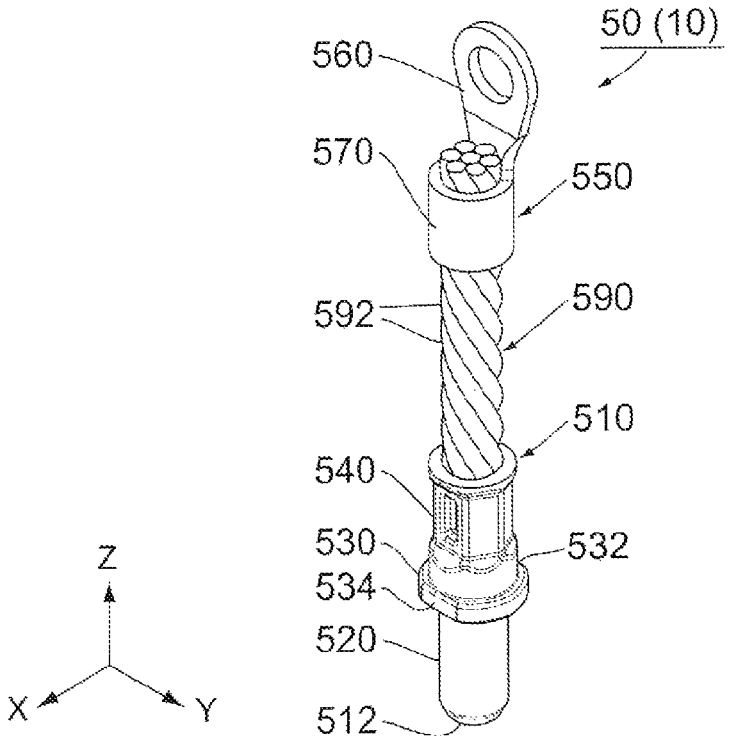
FIG. 15 is a perspective view showing a cable member of the connector of FIG. 3.

As shown in FIG. 15, each of the cable members 50 includes a contact 510 made of metal, a terminal 550 made of metal and a wire 590 made of conductor. The wire 590 includes core wires 592, which are helically twisted together, and includes no insulating coating. In detail, the wire 590 of the present embodiment is formed of the seven core wires 592 each of which is a copper wire, wherein the core wires 592 are twisted together in a clockwise direction. However, the present invention is not limited thereto. For example, there is no particular limitation on material and number of the core wires 592.

The contact 510 has an end 512 in the Z-direction. In addition, the contact 510 has a contact portion 520, a stopped portion 530 and a crimp portion 540. The contact portion 520 is located below the stopped portion 530, and the crimp portion 540 is located above the stopped portion 530. The crimp portion 540 crimps and fixes a lower end of the wire 590. In other words, one of opposite ends, or the lower end, of the wire 590 is fixed to the contact 510. The stopped portion 530 roughly has a circle shape in the XY-plane and protrudes outward in the XY-plane from a boundary between the contact portion 520 and the crimp portion 540.

Referring to FIG. 15, the contact 510 according to the present embodiment is a male contact having a rounded pin shape. However, the present invention is not limited thereto. The contact 510 may be a female contact similar to the mating contact 840 (see FIG. 21) of the present embodiment. In other words, the contact 510 may be a female contact capable of receiving a male contact having a rounded pin shape.

Referring to FIGS. 9 and 15, the contact 510 according to the present embodiment has two regulated portions 532 and 534, namely, a first regulated portion (regulated portion) 532 and a second regulated portion (regulated portion) 534. The regulated portions 532 and 534 according to the present embodiment are provided to the stopped portion 530 and located between the crimp portion 540 and the end 512 in the Z-direction. In detail, each of the regulated portions 532 and 534 is an edge surface which is formed on the stopped portion 530 and extends in parallel to the Z-direction. The regulated portions 532 and 534 are arranged on the sides opposite to each other in a direction perpendicular to the Z-direction, or in a diameter direction of the stopped portion 530.

As shown in FIG. 15, the terminal 550 has a fixed portion 560 and a crimp portion 570. The fixed portion 560 extends upward from the crimp portion 570. The crimp portion 570 has a cylindrical shape. The crimp portion 570 crimps and fixes an upper end of the wire 590. In other words, a remaining one of the opposite ends, or the upper end, of the wire 590 is fixed to the terminal 550. Referring to FIG. 2, the fixed portion 560 of the terminal 550 has a fixed surface 562. The fixed surface 562 is connected to a connection object (not shown) when the connector 10 is used.

Referring to FIGS. 3 and 9, the contacts 510 of the cable members 50 are inserted in the receiving portions 370 of the movable housing 30 from the openings 378, respectively. The thus-inserted contacts 510 are arranged in the Y-direction. During the insertion of the contact 510 through the opening 378, the contact 510 is arranged so that the first regulated portion 532 is located at the negative X-side of the contact 510 and that the second regulated portion 534 is located at the positive X-side of the contact 510. In other words, the contact 510 is arranged so that the first regulated portion 532 faces the guide portion 376 of the movable housing 30 in the X-direction.

Referring to FIGS. 5, 9 and 15, the guide portion 376 guides the stopped portion 530 of the contact 510 so that the stopped portion 530 is inserted into the receiving portion 370 without pivoting motion or with only slight pivoting motion in the XY-plane. Under a state where the contact 510 is completely inserted in the receiving portion 370, the stopped portion 530 is stopped by the bottom surface 370B of the receiving portion 370. In other words, the contact 510 is held by the receiving portion 370 of the movable housing 30. Since the guide portion 376 according to the present embodiment is provided so as to extend about from the bottom surface 370B to the opening 378, the contact 510 can be easily positioned in the XY-plane, and the first regulated portion 532 of the contact 510 can be reliably located at a predetermined position. However, the guide portion 376 does not need to extend exactly to the opening 378. Moreover, the guide portion 376 does not need to be provided.

Figure 28:
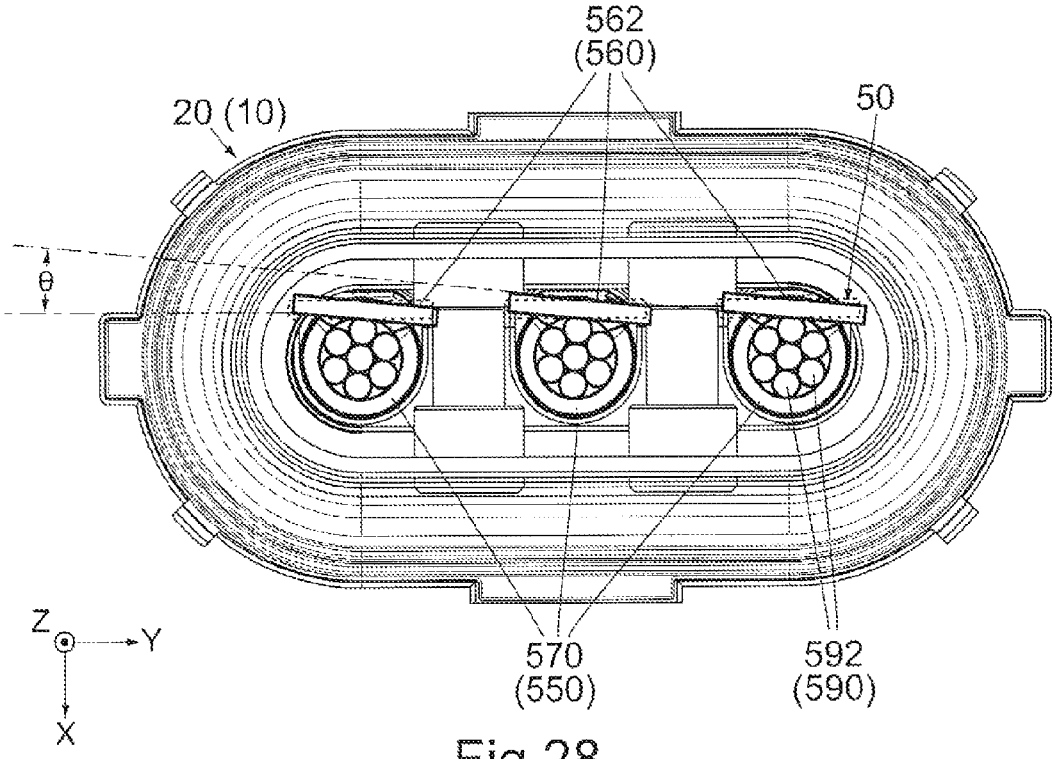
FIG. 28 is a top view showing a part of the connector of FIG. 25, wherein the core wires of each of the wires are not untwisted, and outlines of fixed portions of terminals of the cable members under an untwisted state are illustrated by dashed line.
Figure 29:
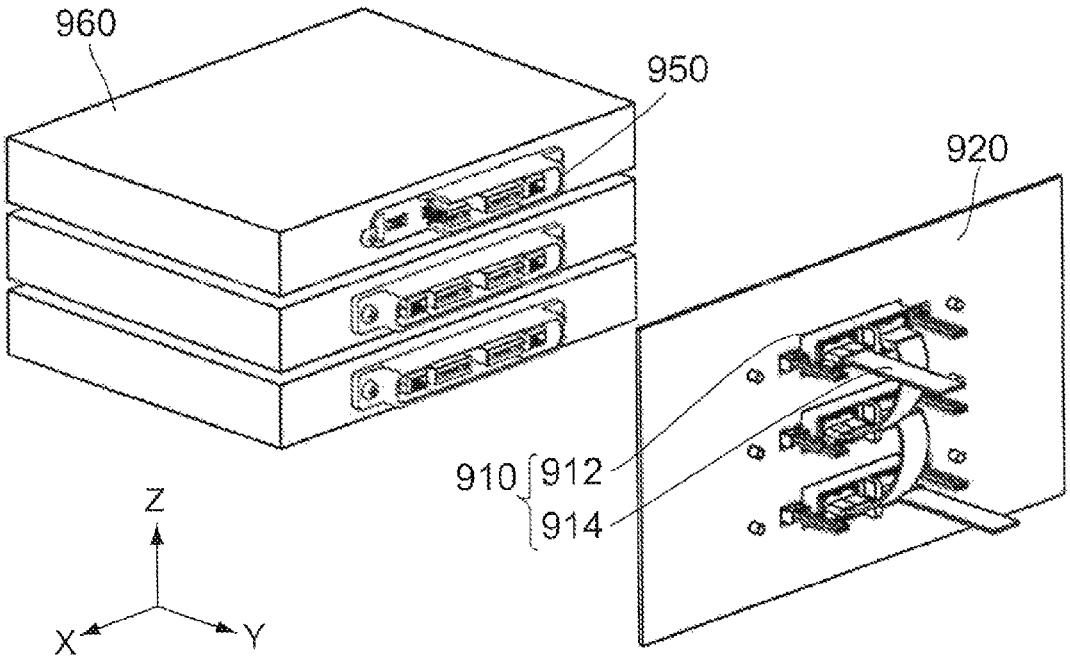
Fig.29 PRIOR ART
FIG. 29 is a perspective view showing connection members and power connectors of Patent Document 1.

Referring to FIGS. 9, 15 and 28, at the time when the contact 510 is just held by the receiving portion 370, the core wires 592 of the wire 590 are helically twisted together as previously described. At that time, the fixed surface 562 of the terminal 550 is rotated by the angle θ relative to the Y-direction. The core wires 592 are untwisted by the angle θ along a counter-clockwise direction, or along a direction opposite to the twisted direction (clockwise direction), after the stopped portion 530 is stopped by the bottom surface 370B.

In detail, referring to FIG. 9, a rotational movement of the first regulated portion 532 of the contact 510 in the XY-plane (predetermined plane) is regulated by the first regulation portion 372 of the movable housing 30. Similarly, a rotational movement of the second regulated portion 534 in the XY-plane is regulated by the second regulation portion 374. In other words, the two regulation portions 372 and 374 regulate the respective rotations of the two regulated portions 532 and 534 in the XY-plane. Accordingly, when the terminal 550 (see FIG. 1) of the cable member 50 is forced to be rotated along the counter-clockwise direction in the XY-plane, the core wires 592 (see FIG. 1) can be untwisted while the contact 510 is hardly rotated in spite of its rounded pin shape.

According to the present embodiment, the rotation of the contact 510 in the XY-plane (predetermined plane) is regulated by the two regulation portions 372 and 374. Moreover, the two regulation portions 372 and 374 are arranged on the sides opposite to each other in the diameter direction of the contact 510. The thus-arranged regulation portions 372 and 374 can reliably regulate the rotation of the contact 510. However, the rotation of the contact 510 may be regulated by only one of the regulation portions 372 and 374. In other words, according to the present invention, the number of set of the regulation portion and the regulated portion may be only one. In contrast, according to the present invention, the number of the aforementioned sets, each of which consists of the regulation portion and the regulated portion, may be three or more. Moreover, the size or the positions of the regulation portions and the regulated portions are not limited to the present embodiment, provided that the rotation of the contact 510 can be regulated.

Figure 16A:
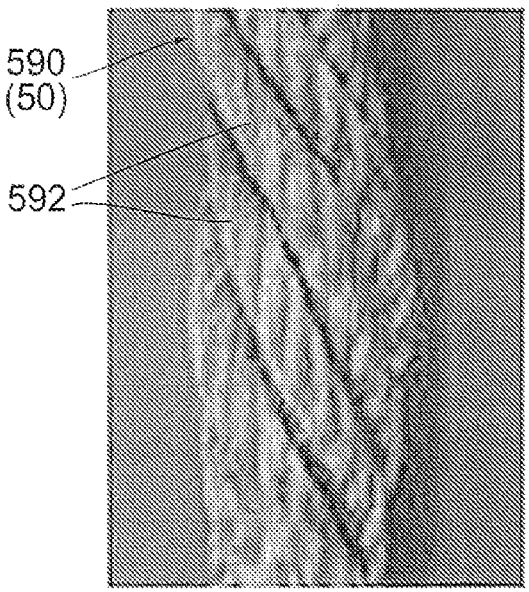
FIG. 16A is a copy of picture showing a part of a wire of the cable member of FIG. 15, wherein core wires of the wire are partially untwisted after being twisted together.
Figure 16B:
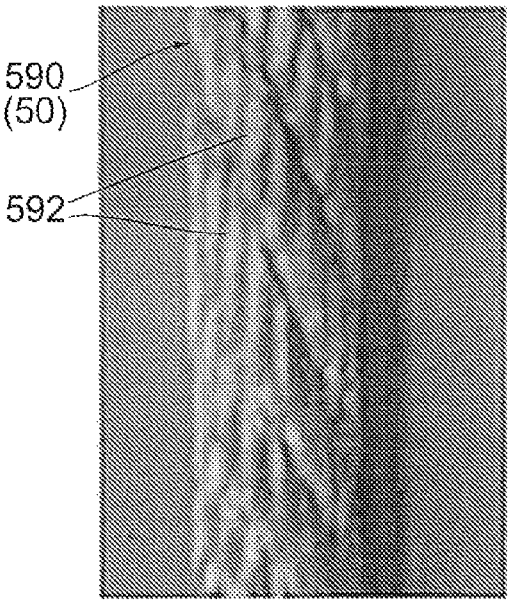
FIG. 16B is a copy of picture showing the wire of FIG. 16A under a state where the core wires are not yet untwisted.

Referring to FIGS. 15 and 25, as described above, the core wires 592 of the wire 590 are untwisted under a state where the wire 590 is fixed to the contact 510 and the terminal 550. Referring to FIG. 28, as a result of this untwisting, the fixed surfaces 562 of the three cable members 50 are arranged on a common plane (see FIG. 25). Referring to FIGS. 16A and 16B, since the wire 590 has no insulating coating, the core wires 592 of the wire 590 after being untwisted (see FIG. 16A) come loose from one another, so that the wire 590 is easily bent in comparison with the wire 590 which is not untwisted (see FIG. 16B). In other words, as a result of the untwisting, the flexibility of the wire 590 is improved. Referring to FIG. 28, in a view point of improvement of the flexibility of the wire 590, the untwisted angle 9 is preferred to be equal to or more than 5 degrees and is further preferred to be equal to or more than 10 degrees.

Referring to FIGS. 26 and 27, the wires 590 according to the present embodiment do not affect the floating movement of the movable housing 30 in the XY-plane because the wires 590 are easily moved in accompany with the movements of the contacts 510 held by the movable housing 30. Thus, the floating structure of the connector 10 according to the present embodiment effectively works in each of two directions perpendicular to the Z-direction, namely, the X-direction and the Y-direction.

Referring to FIG. 3, the fixing member 60 according to the present embodiment includes a retainer 610 made of insulator and an auxiliary retainer 650 made of insulator. In other words, the connector 10 comprises the retainer 610 and the auxiliary retainer 650.

Figure 17:
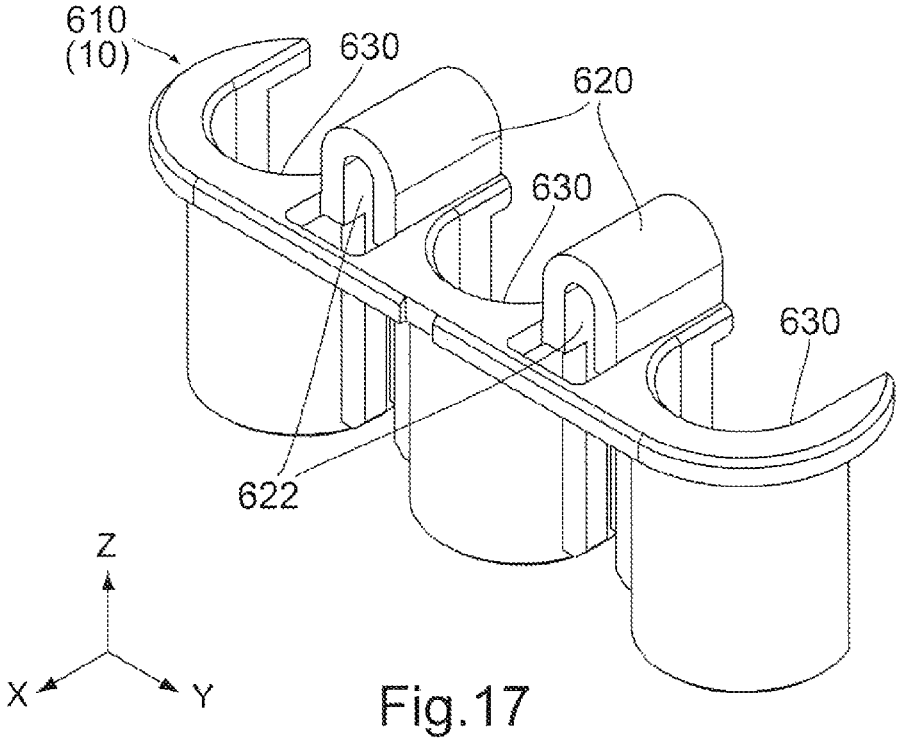
FIG. 17 is a perspective view showing a retainer of the connector of FIG. 3.

As shown in FIGS. 3 and 17, the retainer 610 has two projecting portions 620 and three holding portions 630. Each of the holding portions 630 has a shape which corresponds to that of the contact 510 and opens toward a predetermined side (the negative X-side) of the connector 10 in the X-direction. The holding portions 630 are arranged in the Y-direction. Each of the projecting portions 620 has a U-like shape and couples the upper ends of the two holding portions 630, which are adjacent to each other in the Y-direction, with each other. Each of the projecting portions 620 is formed with an insertion portion 622. The insertion portion 622 is a space which opens outward at opposite sides thereof in the X-direction.

Referring to FIGS. 1 and 3, the retainer 610 is attached to the opposite portion 350 of the movable housing 30 from above. In detail, Referring to FIG. 27, the projecting portions 620 of the retainer 610 are attached to the projecting walls 364 of the movable housing 30, respectively, and the holding portions 630 are received in the receiving portions 370, respectively. The thus-attached holding portions 630 receive the crimp portions 540 of the contacts 510, respectively, so that the stopped portion 530 of each of the contacts 510 is sandwiched between a lower end of the corresponding holding portion 630 and the bottom surface 370B of the corresponding receiving portion 370 in the Z-direction. In other words, the holding portions 630 together with the movable housing 30 hold the contacts 510.

Referring to FIGS. 17 and 26, since the holding portions 630 according to the present embodiment open toward the predetermined side (the negative X-side) of the connector 10 in the X-direction, the holding portions 630 can be easily attached to the movable housing 30 even under a state where the contacts 510 are already held by the receiving portions 370. However, the present invention is not limited thereto. For example, the holding portion 630 may have a closed cross-section in the XY-plane. In this case, for example, the contacts 510 may be connected to the wires 590, respectively, under a state where the holding portions 630 of the retainer 610 hold the contacts 510, respectively, and subsequently, the holding portions 630 may be inserted into the receiving portions 370 together with the contacts 510.

Referring to FIG. 26, the first regulation portion 372 with the guide portion 376 is located toward the negative X-side of the movable housing 30, or toward the predetermined side of the connector 10 toward which the holding portion 630 opens in the X-direction, while the second regulation portion 374 without the guide portion 376 is located toward the positive X-side of the movable housing 30, or toward another side of the connector 10 opposite to the predetermined side in the X-direction. Because of this arrangement, the guide portion 376 does not interfere the insertion of the holding portion 630 into the receiving portion 370. However, the present invention is not limited thereto. For example, the second regulation portion 374 may be provided with a guide portion similar to the guide portion 376. In this case, the positive X-side part of the holding portion 630 may be provided with a ditch which corresponds to this guide portion.

Figure 18:
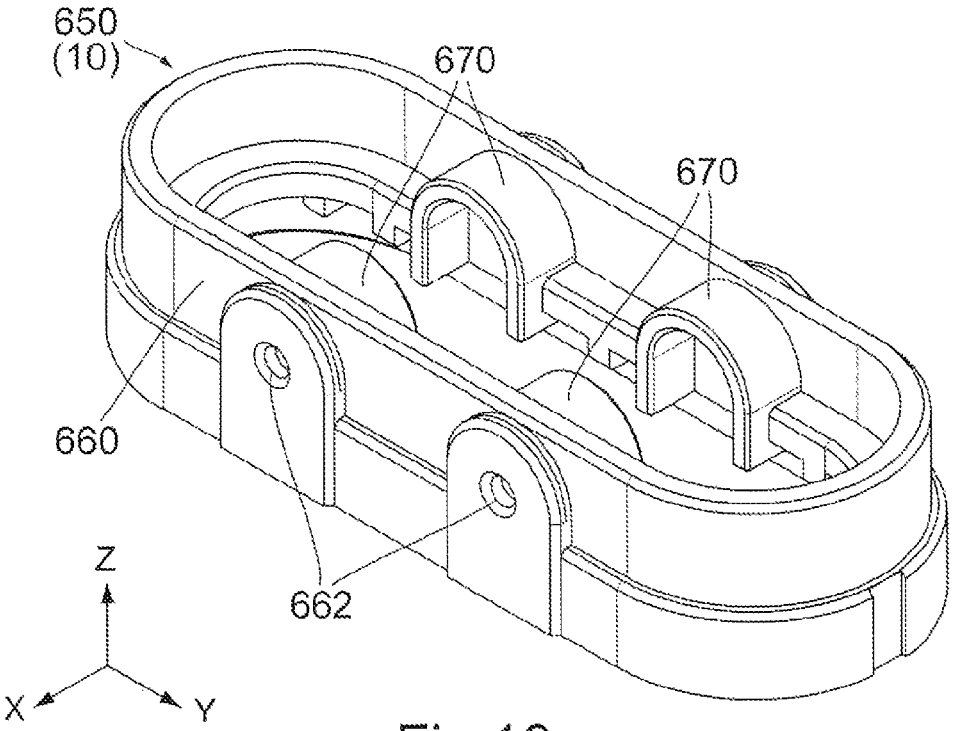
FIG. 18 is a perspective view showing an auxiliary retainer of the connector of FIG. 3.

As shown in FIG. 18, the auxiliary retainer 650 has a body portion 660 and four receiving portions 670. The body portion 660 has a racetrack shape in the XY-plane and is long in the Y-direction. The receiving portions 670 correspond to the projecting portions 360 (see FIG. 3) of the movable housing 30, respectively, and are provided inside of the body portion 660 in the XY-plane. Each of the receiving portions 670 has a half-circle shape bulged upward in the YZ-plane. The body portion 660 of the auxiliary retainer 650 is formed with four insertion portions 662. Each of the insertion portions 662 is a hole which pierces the body portion 660 in the X-direction. Two of the insertion portions 662 are located at the positive Y-side (front side) of the body portion 660 and located at positions same as each other in the YZ-plane. Remaining two of the insertion portions 662 are located at the negative Y-side (rear side) of the body portion 660 and located at positions same as each other in the YZ-plane.

Referring to FIGS. 1, 3, 26 and 27, the body portion 660 of the auxiliary retainer 650 is attached to the retainer 610, which has already held the contacts 510, from above and encloses an upper end of the retainer 610 and an upper end of the movable housing 30. The receiving portions 670 of the thus-attached auxiliary retainer 650 receive the projecting portions 360 of the movable housing 30, respectively. At that time, the positive Y-side (front side) insertion portions 662 of the auxiliary retainer 650 overlap with the positive Y-side (front side) insertion portions 362 of the movable housing 30 and the positive Y-side (front side) insertion portion 622 of the retainer 610 in the YZ-plane. Similarly, the negative Y-side (rear side) the insertion portions 662 of the auxiliary retainer 650 overlap with the negative Y-side (rear side) insertion portions 362 of the movable housing 30 and the negative Y-side (rear side) insertion portion 622 of the retainer 610 in the YZ-plane.

Figure 19:
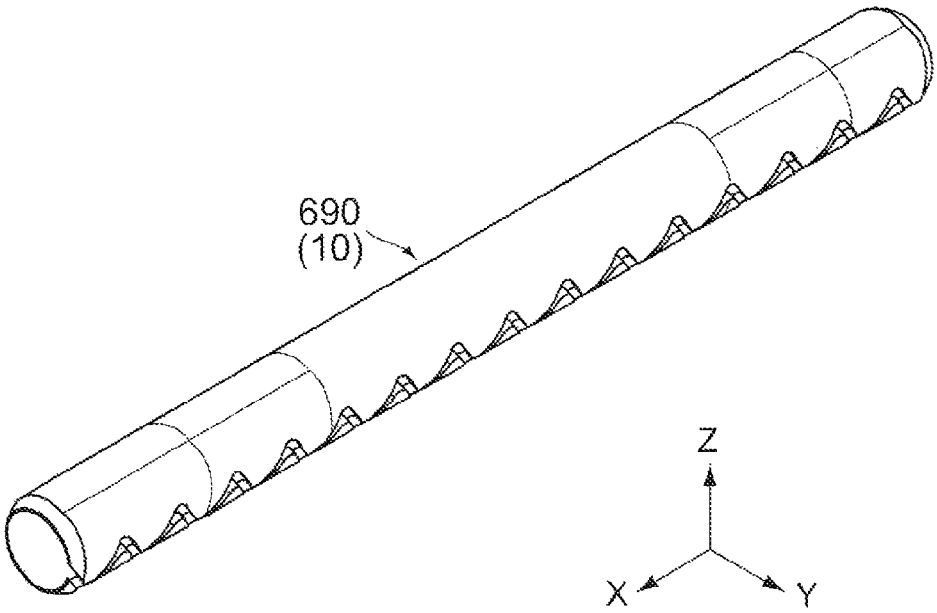
FIG. 19 is a perspective view showing a spring pin of the connector of FIG. 3.

As shown in FIG. 19, the spring pin 690 according to the present embodiment has an opening which extends like a wave in the X-direction. However, the present invention is not limited thereto. The spring pin 690 may be formed in any way, provided that the spring pin 690 is resiliently compressive in the YZ-plane.

Referring to FIGS. 3 and 27, one of the spring pins 690 is inserted in the positive Y-side (front side) insertion portions 362, 622 and 662, and a remaining one of the spring pins 690 is inserted in the negative Y-side (rear side) insertion portions 362, 622 and 662. The thus-inserted spring pins 690 fix the movable housing 30, the retainer 610 and the auxiliary retainer 650 to one another. In other words, the retainer 610 and the auxiliary retainer 650 are coupled with each other by the spring pins 690 each of which is inserted in the insertion portion 622 of the retainer 610 and the insertion portions 662 of the auxiliary retainer 650. Moreover, the auxiliary retainer 650 fixes the retainer 610 to the movable housing 30 with use of the spring pins 690 each of which is inserted in the insertion portions 362 of the movable housing 30. However, the present invention is not limited thereto. The movable housing 30, the retainer 610 and the auxiliary retainer 650 may be fixed to one another in any method.

Referring to FIGS. 22 and 23, the connector 10 is attached to the case 70 when used. In detail, the case 70 is formed with an attachment hole 710 which pierces the case 70 in the Z-direction. The fixed portions 222 (see FIG. 1) of the stationary housing 20 are fixed to the case 70 by screws 720 when the connector 10 is used. In other words, the stationary housing 20 of the connector 10 is attached to the case 70 so as not to be moved relative to the case 70. At that time, a lower part of the connector 10, which includes the flange 220 and the fit portion 310, is located below the case 70, and an upper part of the connector 10 passes through the attachment hole 710 to be located inside of the case 70, for example, inside of the inverter system. The terminals 550 of the cable members 50 are connected to the connection object (not shown).

As can be seen from FIGS. 26 and 27, the case 70 with the stationary housing 20 fixed thereto presses the first fixed portion 410 of the sealing member 40 against the bottom surface of the fixing portion 240 of the stationary housing 20. The thus-pressed first fixed portion 410 is securely fixed to the fixing portion 240 while being elastically deformed. In addition, the body portion 660 of the auxiliary retainer 650 attached to the retainer 610 presses the second fixed portion 420 of the sealing member 40 against the fixing portion 352 of the movable housing 30. The thus-pressed second fixed portion 420 is securely fixed to the fixing portion 352. Thus, the sealing member 40 prevents water from invading between the stationary housing 20 and the movable housing 30 and therefore prevents water from invading within the case 70 from below (outside) the case 70.

Referring to FIGS. 22 to 24, the connector 10 is mateable with the mating connector 80 along the Z-direction under a state where the fixed portions 222 (see FIG. 1) are fixed to the case 70 and the mating fixed portions 818 are fixed to the mating case 880. In other words, the connector 10 is mateable with the mating connector 80 under a state where the position of the stationary housing 20 in the XY-plane is fixed and the position of the mating connector 80 in the XY-plane is fixed. In the mating process, the mating fit portion 810 of the mating connector 80 is accommodated in the accommodation portion 312 (see FIG. 12) of the connector 10, and the fit portion 310 of the connector 10 is received in the recessed portion 824 of the mating connector 80.

Referring to FIGS. 26 and 27, during the process in which the fit portion 310 is received into the recessed portion 824, even if the position of the fit portion 310 in the XY-plane is displaced to some extent relative to the position of the recessed portion 824 in the XY-plane, the movable housing 30 is floatingly moved in the XY-plane so that the fit portion 310 is positioned to the recessed portion 824 and the mating fit portion 810.

Referring to FIGS. 22 to 24, as a result of the aforementioned positioning between the fit portion 310 and the mating fit portion 810, each of the contacts 510 (see FIG. 26) is positioned to the corresponding mating contact 840 in the XY-plane and received in the corresponding mating contact 840. Thus, the connection object (not shown) of the connector 10 is electrically connected with the mating connection object (not shown) of the mating connector 80.

Referring to FIGS. 26 and 27, under a mated state of the connector 10 with the mating connector 80, the fit portion 310 of the connector 10 presses the mating sealing member 830 against the mating housing 820. The thus-pressed mating sealing member 830 is elastically deformed so as to prevent water from invading between the movable housing 30 and the mating housing 820.

The present embodiment can be modified variously in addition to the already described modifications. For example, the connector 10 may comprise a plurality of the cable members 50 or otherwise may comprise only one cable member 50.

Referring to FIG. 28, at the time when the connector 10 is formed, the core wires 592 of the wire 590 do not need to be untwisted. In this case, when each of the wires 590 is stretched along the Z-direction under the state where the connector 10 is formed, each of the fixed surfaces 562 is rotated by the angle θ, or by 5 degrees or more, relative to the Y-direction along the twisted direction of the core wires 592. The core wires 592 of the thus-formed connector 10 is untwisted when the connector 10 is used, so that the fixed surfaces 562 are located on the common plane (the YZ-plane) when the connector 10 is used.

The present application is based on a Japanese patent application of JP2015-102941 filed before the Japan Patent Office on May 20, 2015, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a mating direction, the connector comprising a stationary housing, a movable housing and a cable member, wherein:

the movable housing is movable relative to the stationary housing in a predetermined plane perpendicular to the mating direction;

the cable member includes a contact, a terminal and a wire;

the contact is held by the movable housing;

the wire includes core wires which are helically twisted together;

one of opposite ends of the wire is fixed to the contact, and a remaining one of the opposite ends of the wire is fixed to the terminal;

the movable housing has a regulation portion;

the contact has a regulated portion; and the regulation portion regulates a rotation of the regulated portion in the predetermined plane.

2. The connector as recited in claim 1, wherein the contact is a male contact having a rounded pin shape.

3. The connector as recited in claim 1, wherein the contact is a female contact capable of receiving a male contact having a rounded pin shape.

4. The connector as recited in claim 1, wherein:

the contact has a crimp portion;

the crimp portion crimps and fixes the wire;

the regulated portion is located between the crimp portion and an end of the contact;

the movable housing has a receiving portion and a guide portion;

the receiving portion has an opening located at an end thereof in the mating direction;

the contact is inserted in the receiving portion through the opening; and the guide portion continuously extends from the regulation portion toward the opening.

5. The connector as recited in claim 4, wherein:

the movable housing has a first regulation portion and a second regulation portion each of which is the regulation portion;

the guide portion continuously extends from the first regulation portion toward the opening; and the second regulation portion is provided with no guide portion.

6. The connector as recited in claim 4, the connector comprising a retainer and an auxiliary retainer, wherein:

the retainer has a holding portion;

the holding portion opens toward a predetermined side of the connector in a width direction perpendicular to the mating direction, and holds the contact; and the auxiliary retainer fixes the retainer to the movable housing.

7. The connector as recited in claim 6, wherein:

the movable housing has a first regulation portion and a second regulation portion each of which is the regulation portion;

the first regulation portion is located toward the predetermined side in the width direction, while the second regulation portion is located toward another side of the connector opposite to the predetermined side in the width direction;

the guide portion continuously extends from the first regulation portion toward the opening; and the second regulation portion is provided with no guide portion.

8. The connector as recited in claim 1, the connector comprising a retainer and an auxiliary retainer, wherein:

the retainer has a holding portion;

the holding portion opens toward a predetermined side of the connector in a width direction perpendicular to the mating direction, and holds the contact; and the auxiliary retainer fixes the retainer to the movable housing.

9. The connector as recited in claim 8, wherein:

each of the retainer and the auxiliary retainer is formed with an insertion portion; and the retainer and the auxiliary retainer are coupled with each other by a spring pin which is inserted in the insertion portion of the retainer and the insertion portion of the auxiliary retainer.

10. The connector as recited in claim 9, wherein:

the movable housing is formed with another insertion portion; and the movable housing, the retainer and the auxiliary retainer are fixed to one another by the spring pin which is inserted in the insertion portion of the movable housing.

11. The connector as recited in claim 1, wherein the core wires are partially untwisted under a state where the wire is fixed to the contact and the terminal.

12. The connector as recited in claim 1, the connector comprising a plurality of the cable members, wherein:

the contacts are arranged in a pitch direction perpendicular to the mating direction;

each of the terminals has a fixed surface which is connected to a connection object when the connector is used; and when each of the wires is stretched along the mating direction, each of the fixed surfaces is rotated by 5 degrees or more relative to the pitch direction along a direction in which the core wires are twisted.

13. The connector as recited in claim 1, wherein:

the stationary housing has a fixed portion which is fixed to an object when the connector is used;

the mating connector has a mating fixed portion which is fixed to a mating object when the mating connector is used; and the connector is mateable with the mating connector under a state where the fixed portion is fixed to the object and the mating fixed portion is fixed to the mating object.

14. The connector as recited in claim 1, the connector comprising a sealing member, wherein:

the sealing member has a first fixed portion, a second fixed portion and a middle portion;

the first fixed portion is fixed to the stationary housing;

the second fixed portion is fixed to the movable housing;

the first fixed portion is connected to the second fixed portion via the middle portion with no break in a cross-section in parallel to the mating direction; and the middle portion is looped with no break in a plane perpendicular to the mating direction.

15. The connector as recited in claim 14, wherein the sealing member is wholly made of elastomer.

16. The connector as recited in claim 15, wherein the middle portion of the sealing member is thinner than both the first fixed portion and the second fixed portion.

* * * * *